US005385478A

United States Patent [19]

Niekawa

[11] Patent Number: 5,385,478

[45] Date of Patent: Jan. 31, 1995

[54] SHEET-LIKE CONTACT DEVICE AND A CONNECTOR USING THIS DEVICE

[75] Inventor: Yukihisa Niekawa, Kawasaki, Japan

[73] Assignee: Fujisoku Corporation, Kawasaki, Japan

[21] Appl. No.: 183,129

[22] Filed: Jan. 14, 1994

Related U.S. Application Data

[63] Continuation of Ser. No. 987,028, Dec. 7, 1992, abandoned.

[30] Foreign Application Priority Data

Dec. 13, 1991 [JP] Japan ..... 3-330360

[51] Int. Cl.[6] ..... H01R 9/07

[52] U.S. Cl. ..... 439/67; 439/39; 439/347; 439/495; 439/570; 439/632

[58] Field of Search ..... 439/62, 67, 77, 493, 439/495, 496, 632, 636, 637, 329, 347

[56] References Cited

U.S. PATENT DOCUMENTS

| | | | |
|---|---|---|---|
| 3,082,398 | 3/1963 | Valach | 439/496 |
| 3,149,897 | 9/1964 | Martinek | 439/631 |
| 3,562,798 | 2/1971 | Bragg, Jr. | 439/493 |
| 4,477,134 | 10/1984 | Wright | 439/67 |
| 4,740,867 | 4/1988 | Roberts et al. | 439/67 |
| 4,802,866 | 2/1989 | Balzano et al. | 439/496 |
| 4,986,769 | 1/1991 | Adams, III et al. | 439/347 |
| 5,009,607 | 4/1991 | Gordon et al. | 439/77 |
| 5,076,803 | 12/1991 | Mutarelli et al. | 439/493 |

OTHER PUBLICATIONS

IBM Technical Disclosure, Dunman, vol. 7, No. 3, p. 182, Aug. 1964.

*Primary Examiner*—Neil Abrams
*Attorney, Agent, or Firm*—Ladas & Parry

[57] ABSTRACT

A sheet-like first contact member, formed as a TAB tape, is housed in a socket, and a sheet-like second contact member, also formed as a TAB tape, is mounted on an insert portion of a plug that can be inserted into the socket. A plurality of first contact elements are patterned on the first contact member, and a plurality of second contact elements are patterned on the second contact member. The first member held in a curved state in a frame so that the first contact elements are curved and have raised central portions and a plurality of springs are mounted at the back of the first contact member in correspondence with the first contact elements. When the plug is inserted into the socket, the first and second contact elements are brought into contact with one another by the stress of the curved first contact elements and the force of the springs.

12 Claims, 22 Drawing Sheets

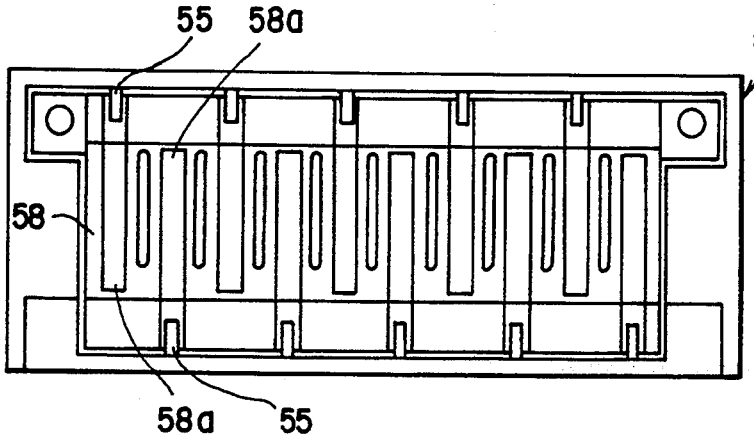
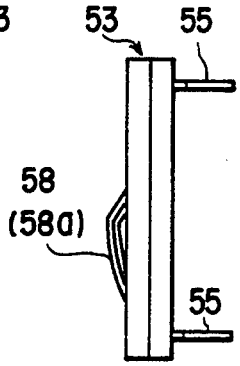
F I G. 35A F I G. 35B
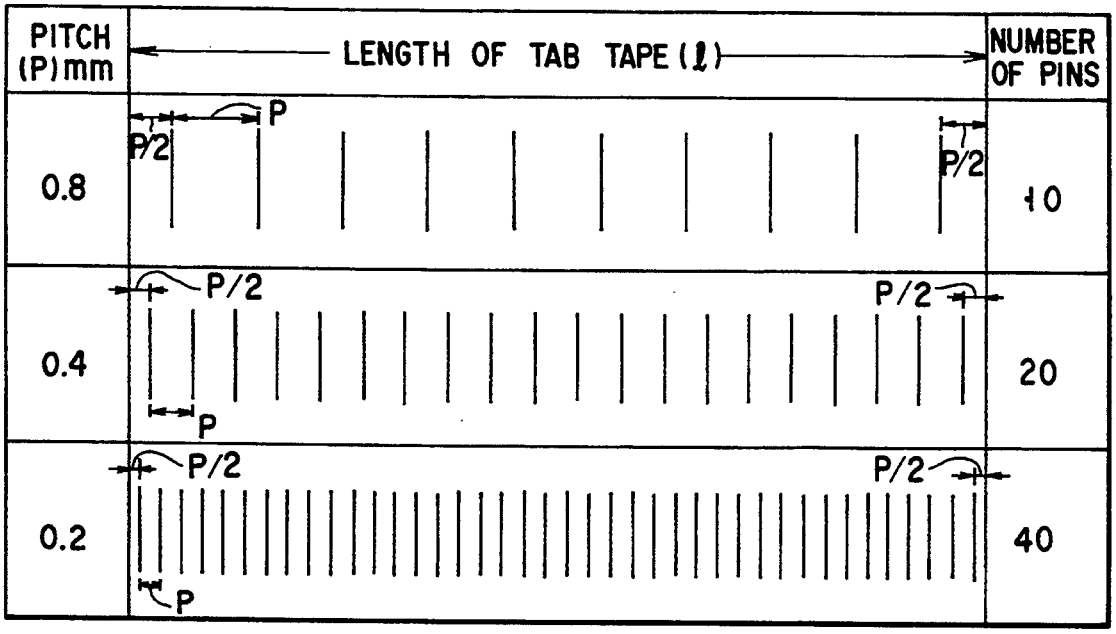
F I G. 36

SHEET-LIKE CONTACT DEVICE AND A CONNECTOR USING THIS DEVICE

This is a continuation of copending application Ser. No. 07/987,028 filed on Dec. 7, 1992 and now abandoned.

BACKGROUND OF THE INVENTION

1. Field of the Invention

This invention relates to a sheet-like contact device used for a connector device which connects, for example, flat cables, flexible boards, or the like, and for a switch.

2. Description of the Related Art

FIG. 2 shows a conventional connector device. A connector body 11 is molded out of resin. In the connector body 11, a plurality of housing sections 11*a* are formed. A contact element 12 is placed in each housing section 11*a*. Those contact elements 12 are insulated from each other with partitions 11*b* between housing sections 11*a*.

Today, electronic equipment using such connector devices is getting more and more compact, and there arises a strong desire to make connector devices more compact. For conventional connector devices, however, because partitions 11*b* intervene between contact elements 12, the distance between adjacent contacts 12 has been difficult to reduce to 0.5 mm or less.

In the case of the conventional connector device 11, since the miniaturization of the contact elements 12 is approaching its limit, this makes the manufacture more difficult. Additionally, it is getting difficult to make the size of connector devices more compact and thinner.

SUMMARY OF THE INVENTION

The object of the present invention is to provide a sheet-like contact device capable of shortening the distance between adjacent contacts, facilitating the assembly, and allowing a very compact and thin design.

The other object of the present invention is to provide an ultra-compact connector device and a switch using the sheet-like contact device.

The foregoing object is accomplished by providing a connector device comprising: a first holder with a housing section; a first contact member housed in the housing section of the first holder, with a plurality of first contact elements patterned on the surface of the first contact member; a second holder with a housing section attached to the first holder; a second contact member housed in the housing section of the second holder, with a plurality of second contact elements with which the first contact elements make contact patterned on the surface of the second contact member; and an elastic member housed in the housing section of the second holder, which presses the contact member toward the first contact member.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 35A and 35B show the eighth embodiment, FIG. 35A being a plan view of a connected state different from those of FIGS. 33 and 34, and FIG. 35B being a side view;

FIG. 36 is a plan view used to explain the pitch of the first contact elements provided on a TAB tape;

DETAILED DESCRIPTION OF THE PREFERRED EMBODIMENTS

Referring to the accompanying drawings, embodiments of the present invention will be explained.

Figure 1:
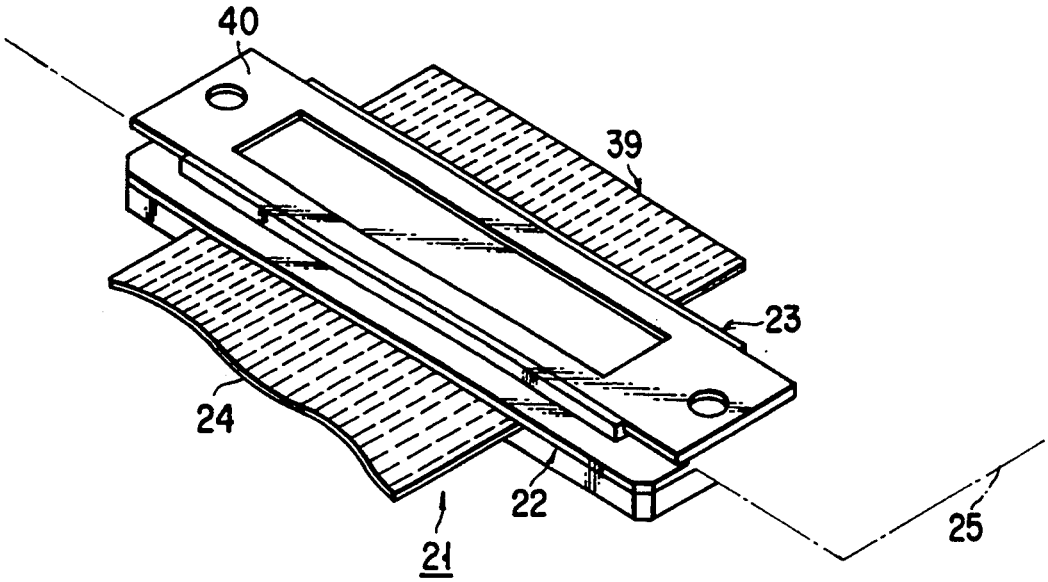
FIG. 1 is a perspective view of a first embodiment of the present invention.
Figure 2:
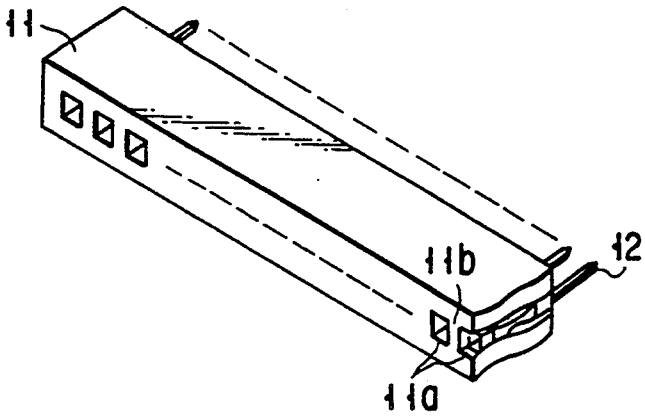
PRIOR ART F I G. 2
FIG. 2 is a perspective view of a conventional connector device, with parts broken away.

FIG. 1, which is associated with a first embodiment of the present invention, shows an external appearance of a connector device 21. In FIG. 1, the connector device 21 is composed of a first connector section 22 and a second connector section 23 connected thereto. The first connector section 22 is connected to, for example, a flat cable 24, whereas the second connector cable 25 is attached to, for example, a printed-wiring board 25. These first and second connector sections 22 and 23 adhere to each other by the action of a permanent magnet, which will be explained later. In this state, the flat cable 24 and printed-wiring board 25 are 10 electrically connected to one another via first and second contact elements explained later.

Figure 3:
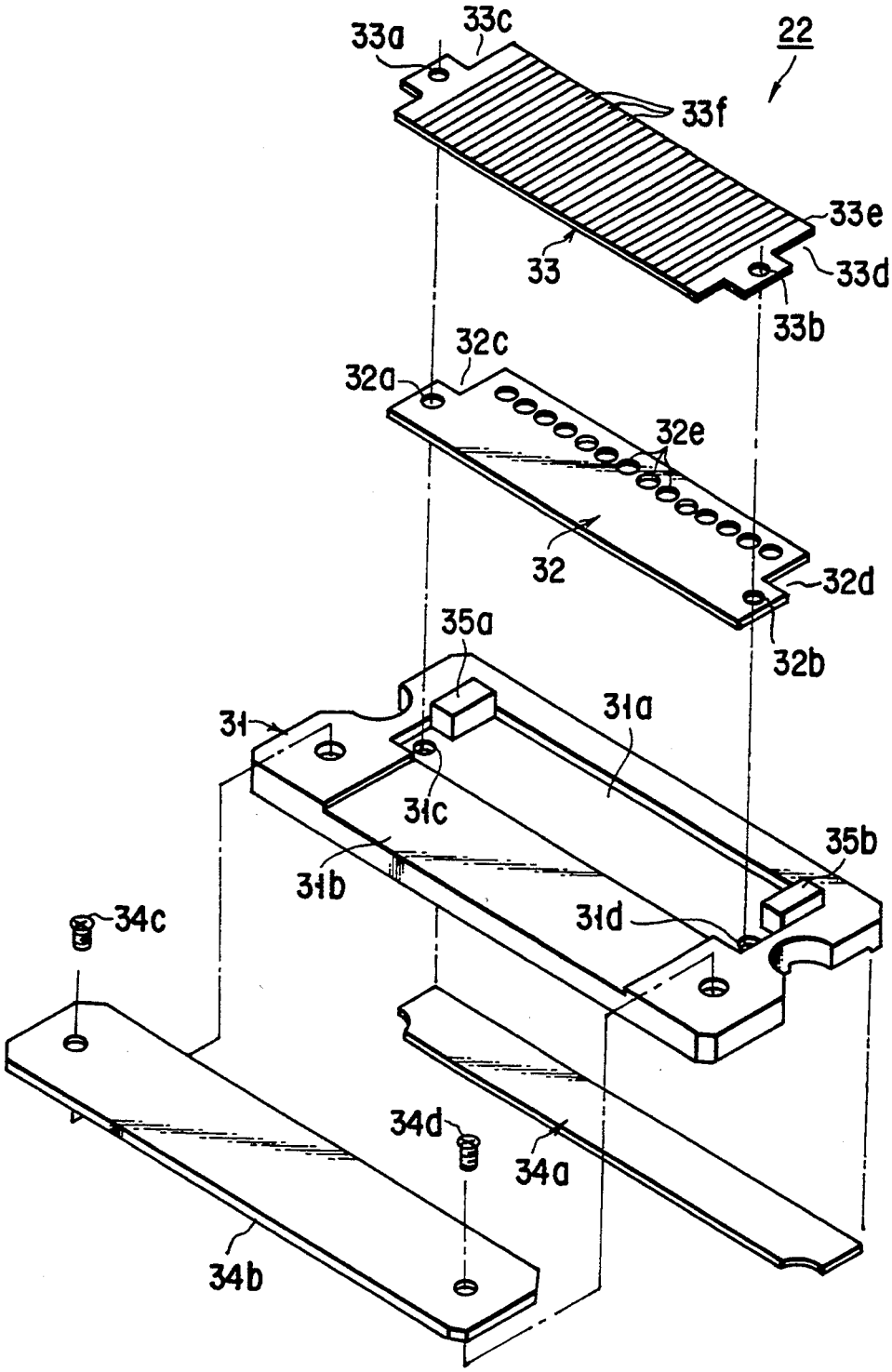
FIG. 3 is an exploded perspective view of a first connector section of FIG. 1.

FIG. 3 shows the first connector section 22. At the surface of a first holder 31 of, for example, resin are formed a first housing section 31*a* and a second housing section 31*b* shallower than the first housing section 31*a* and connected to the latter. At both ends of the first housing section 31*a* across its length, through holes 31*c* and 31*d* are made. The first housing section 31*a* houses, for example, an iron plate 32 and a plate-like first contact member 33.

Through holes 32*a* and 32*b* are made at both ends of the plate 32 along its length so as to correspond to the through holes 31*c* and 31*d*. Cutout portions 32*c* and 32*d* are formed near through holes 32*a* and 32*b*. A plurality of through holes 32*e* are made in one side of the plate 33 across its length between the cutout portions 32*a* and 32*d*.

At both ends of the first contact member 33 across its length are made through holes 33*a* and 33*b* so as to correspond to the through holes 31*c* and 31*d*, near which cutout portions 33*c* and 33*d* are formed. The first contact member 33 is produced by TAB (Tape Automated Bonding) techniques. Specifically, TAB tape 33*e* is of a two-layer structure of, for example, an insulating film and copper foil. On the front of the TAB tape 33*e*, a plurality of first contact elements 33*f* of copper foil are patterned so as to correspond to the plurality of through holes 32*e* in the plate 32. The back of the first contact member 33 is bonded to the front of the plate 32, the back of which is bonded to the housing section 31*a*.

To the back of the first holder 31 is attached, for example, an iron plate 34*a*, whereas to the front of the first holder 31, for example, a fixing plate 34*b* of resin is used to fix a flat cable to be housed in the second housing section 31B is secured with screws 34*c* and 34*d*. The method of attaching the fixing plate 34*b* is not limited to screws, but may be achieved by known thermal contact bonding techniques.

Figure 5A:
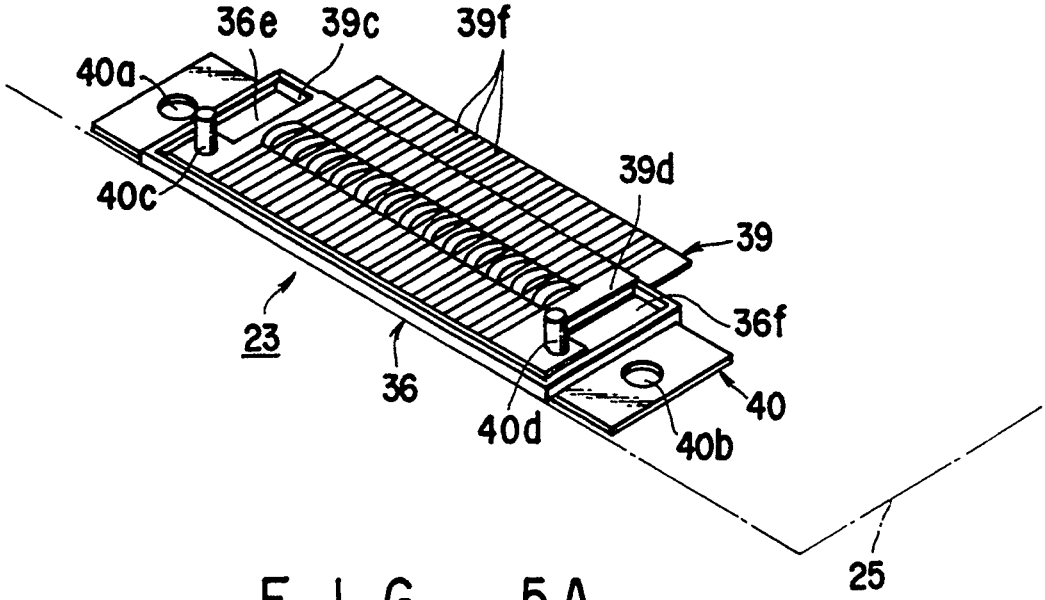
FIG. 5A is a perspective view of the assembled state of the second connector section of FIG. 4.
Figure 5B:
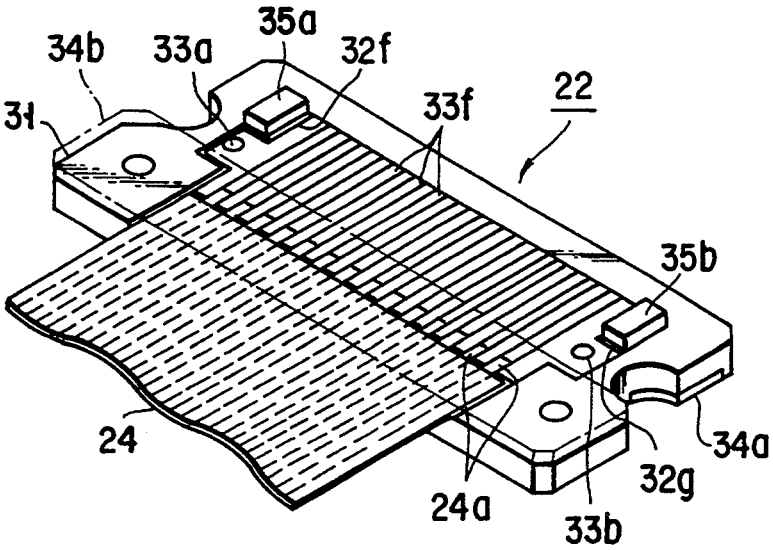
FIG. 5B is a perspective view of the assembled state of the first connector section of FIG. 3.

FIG. 5B illustrates the assembled state of the first connector section 22. With the plate 32 and first contact member 33 in the housing section 31*a*, recessed portions 32*f* and 32*g* are formed in the housing section 31*a* by the cutout portions 32*c*, 33*c*, 32*d*, and 33*d* of the plate 32 and first contact member 33. In the recessed portions 32*f* and 32*g*, permanent magnets 35*a* and 35*b* are placed. The permanent magnets 35*a* and 35*b* are arranged so as to correspond to both ends of the plate 34*a*.

The first contact elements 33*f* provided on the first contact member 33 are connected to the leads 24*a* of the flat cable 24 placed in the second housing section 31*b* with, for example, cream solder (not shown). The flat cable 24 is fastened to the first holder 31 with the fixing plate 34*b*.

Figure 4:
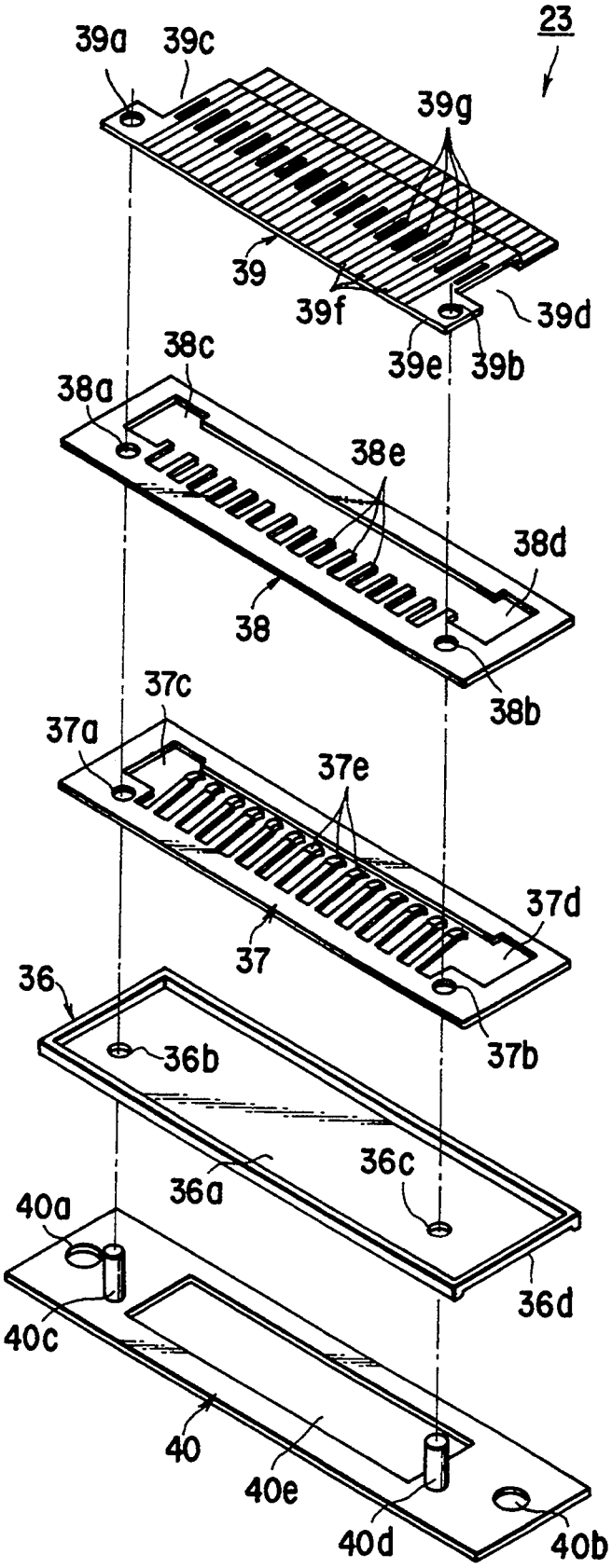
FIG. 4 is an exploded perspective view of a second connector section of FIG. 1.

FIG. 4 shows the second connector section 23. A housing section 36*a* is formed at the surface of a second holder 36 of, for example, resin. At both ends of the housing section 36*a* across its length, through holes 36*b* and 36*c* are made so as to correspond to the through holes 31*c* and 31*d* made in the first housing section 31*a* of FIG. 3. In the housing section 36*a*, an elastic member 37, a spacer 38, and a second contact member 39 are housed.

Through holes 39*a* and 39*b* are made at both ends of the second contact member 39 across its length so as to correspond to the through holes 36*b* and 36*c*. Near the through holes 39*a* and 39*b*, cutout portions 39*c* and 39*d* are formed. Like the first contact member 33, the second contact member 39 is produced by TAB techniques. Specifically, a plurality of second contact elements 39*f* of copper foil are patterned on the surface of TAB tape 39*e* so as to correspond to the first contact elements 33*f* provided on the first contact member 33. Slits 39*g* are made on both sides of each of the second contact element 39*f*. One end of the second contact member 39 across its width is bent along one side of the second holder 36.

The spacer 38 is made of, for example, iron. Through holes 38*a* and 38*b* are made at both ends of the spacer 38 along its length so as to correspond to the through holes 36*b* and 36*c*. Near the through holes 38*a* and 38*b*, cutout portions 38*c* and 38*d* are formed. A plurality of extended portions 38*e* are formed between the through holes 38*a* and 38*b* so as to correspond to the slits 39*g* made in the second contact member 39.

The elastic member 37 is made of, for example, phosphor bronze. At both ends of the elastic member 37 along it length, through holes 37*a* and 37*b* are made so as to correspond to the through holes 36*b* and 36*c*. Cutout portions 37*c* and 37*d* are formed near the through holes 37*a* and 37*b*. A plurality of springs 37*e* are provided between the through holes 37*a* and 37*b* so as to correspond to the second contact elements 39*f* provided on the second contact member 39. The tips of those springs 37*e* press the back of the second contact member 39 in the positions corresponding to the second contact elements 39*f* between the slits 39*g*.

On the back of the second holder 36, a recessed portion 36*d* is longitudinally formed. To this recessed portion 36*d*, for example, an iron frame 40 is attached. At both ends of the frame 40 across its length, for example, through holes 40*a* and 40*b* are made for screws. Projections 40*c* and 40*d* are provided between the through holes 40*a* and 40*b* so as to correspond to the through holes 36*b* and 36*c*. Between those projections 40*c* and 40*d*, an opening 40*e* is made.

In the state where the frame 40 is attached to the back of the second holder 36 with the projections 40*c* and 40*d* passing through the through holes 36*b* and 36*c* in the second holder 36, when the elastic member 37, spacer 38, and second contact member 39 are housed in the housing section 36*a* of the second holder 36, this will permit the projections 40*c* and 40*d* of the frame 40 to pass through the through holes 37*a*, 38*a*, and 39*a* and the through holes 37*b*, 38*b*, and 39*b* of the elastic member 37, spacer 38, and second contact member 39.

The elastic member 37, spacer 38, and second contact member 39 are bonded together. Specifically, the periphery of the back of the second contact member 39 is bonded to the periphery of the front of the spacer 38, and the periphery of the front of the elastic member 37 is bonded to the periphery of the back of the spacer 38. The periphery of the back of the elastic member 37 is bonded to the housing section 36*a* of the second holder 36.

FIG. 5A shows the assembled state of the second connector section 23. The second contact elements 39*f* of the second contact member 39 are projected upward in each mid section by the springs 37*e*. Those projected portions correspond to the through holes 32*e* made in the plate 32 shown in FIG. 3.

With the frame 40 attached to the printed-wiring board 25, the second contact elements 39*f* located at the end at which the second contact member 39 is bent are connected to the wiring pattern (not shown) of the printed-wiring board 25.

Further, recessed portions 36*e* and 36*f* are formed in the housing section 36*a* so as to correspond to the cutout portions 37*c*, 38*c*, and 39*c* and cutout portions 37*d*, 38*d*, and 29*d* of the elastic member 37, spacer 38, and second contact member 39.

When the second connector section 23 assembled as shown in FIG. 5A is connected to the first connector section 22 as put together as shown in FIG. 5B, the projections 40*c* and 40*d* of the second connector section 23 are fitted into the through holes 33*b* and 33*a* of the first connector section 22. This allows the first contact elements 33*f* to come into contact with the projected mid portions of the second contact elements 39*f*. Permanent magnets 35*a* and 35*b* are housed in the recessed portions 36*f* and 36*e* of the second connector section 23, respectively. These permanent magnets 35*a* and 35*b*, together with the plate 34*a* and frame 40, form a closed magnetic path. Therefore, the attractive force of the permanent magnets 35*a*, 35*b*, plate 34*a*, and frame 40 keeps the first and second connector sections 22 and 23 connected to each other. To disconnect the first and second connector sections 22 and 23 from one another, what should be done is just to pull the first and second connector sections 22 and 23 apart against the attractive force of the permanent magnet 35*a*, 35*b*.

With the embodiment, the width of the first and second contact elements 33*f* and 39*f* and the distance between them can be made very fine with a high accuracy, because the first and second contact elements 33*f* and 39*f* are formed on the first and second contact members 33 and 39 by chemical etching techniques used in TAB. Thus, as compared with conventional connector devices, the pitch at which the contact elements are arranged can be made very fine. In the present embodiment, the pitch of the first and second contact elements 33*f* and 39*f* could be made as fine as 0.37 mm.

Because each material constituting the first and second connector sections 22 and 23 is a thin plate, these connector sections 22 and 23 can be made ultra-thin. With the embodiment, their thickness can be made as thin as on the order of 3 mm in the state where the first and second connectors 22 and 23 are connected to each other.

The second contact elements 39*f* are pressed by the springs 37*e* of the elastic member 37 toward the first contact elements 33*f*. As a result, this enables the first contact elements 33*f* to make contact with the second contact elements 39*f* stably.

Further, the first and second connector sections 22 and 23 attract each other by the force of the permanent magnets 35*a* and 35*b*. This allows the first and second connectors 22 and 23 to connect to each other with sufficient force, even if they are made ultra-thin as noted above.

Additionally, because the permanent magnets 35*a* and 35*b* form a closed magnetic path together with the plate 34*a* and frame 40, the amount of magnetic leakage from the connector device is extremely small. Consequently, the connector device has no adverse effect on electronic equipment to which this device is installed.

The first and second contact elements 33*f* and 39*f* are formed by etching; the first connector section 22 is assembled by bonding the plate 32, first contact member 33, and others in sequence; the second connector section 23 is put together by bonding the elastic member 37, spacer 38, second contact member 39, and others in sequence; and the plurality of springs 37*e* are integrally formed with the elastic member 37. In this way, the assembly of the device is easy.

Covering the entire surface of the back of the first and second contact members 33 and 39 makes it possible to transmit the signal at higher speeds.

Figure 6:
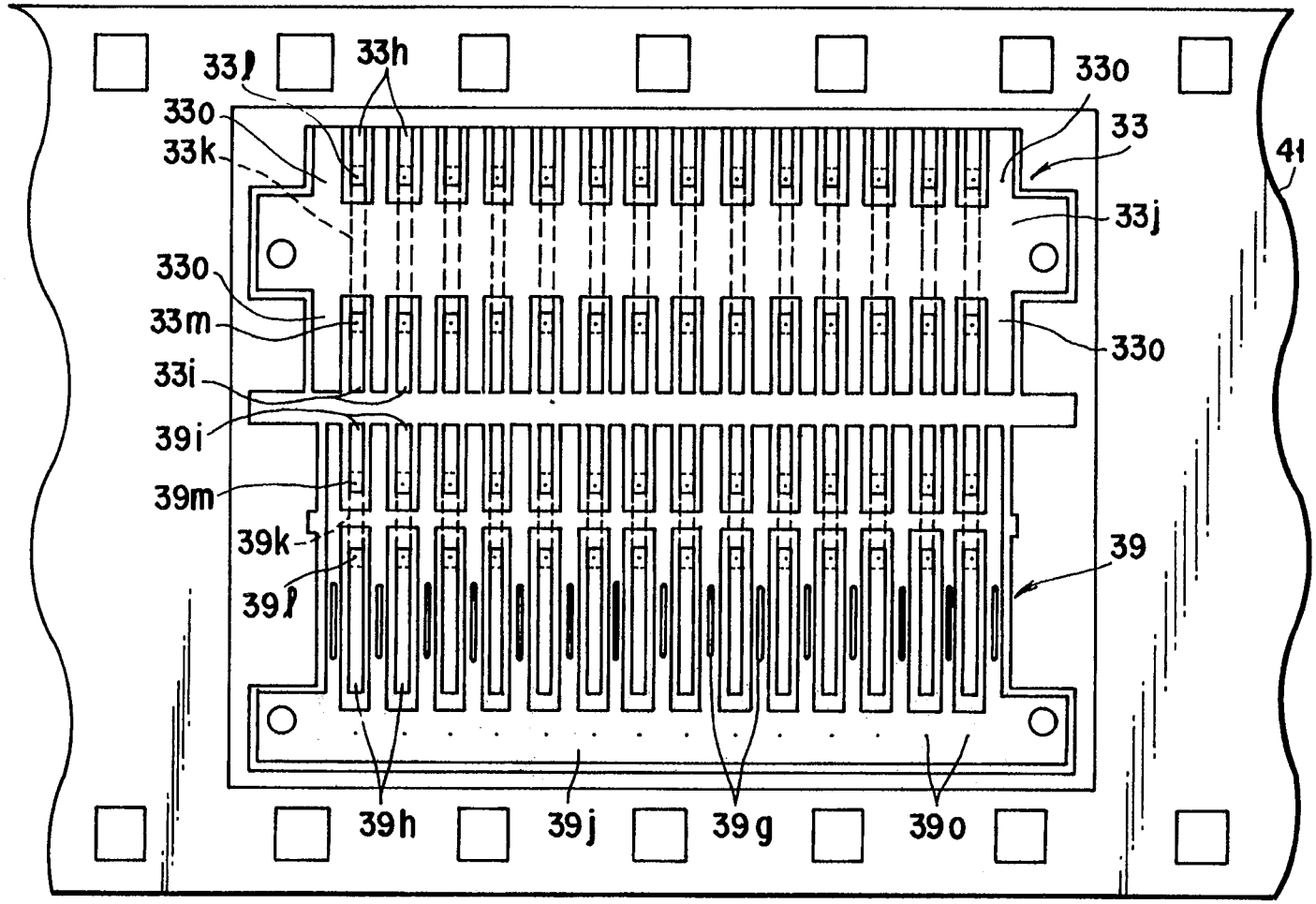
FIG. 6 is a top view of a modification of a first and a second contact plate.
Figure 7:
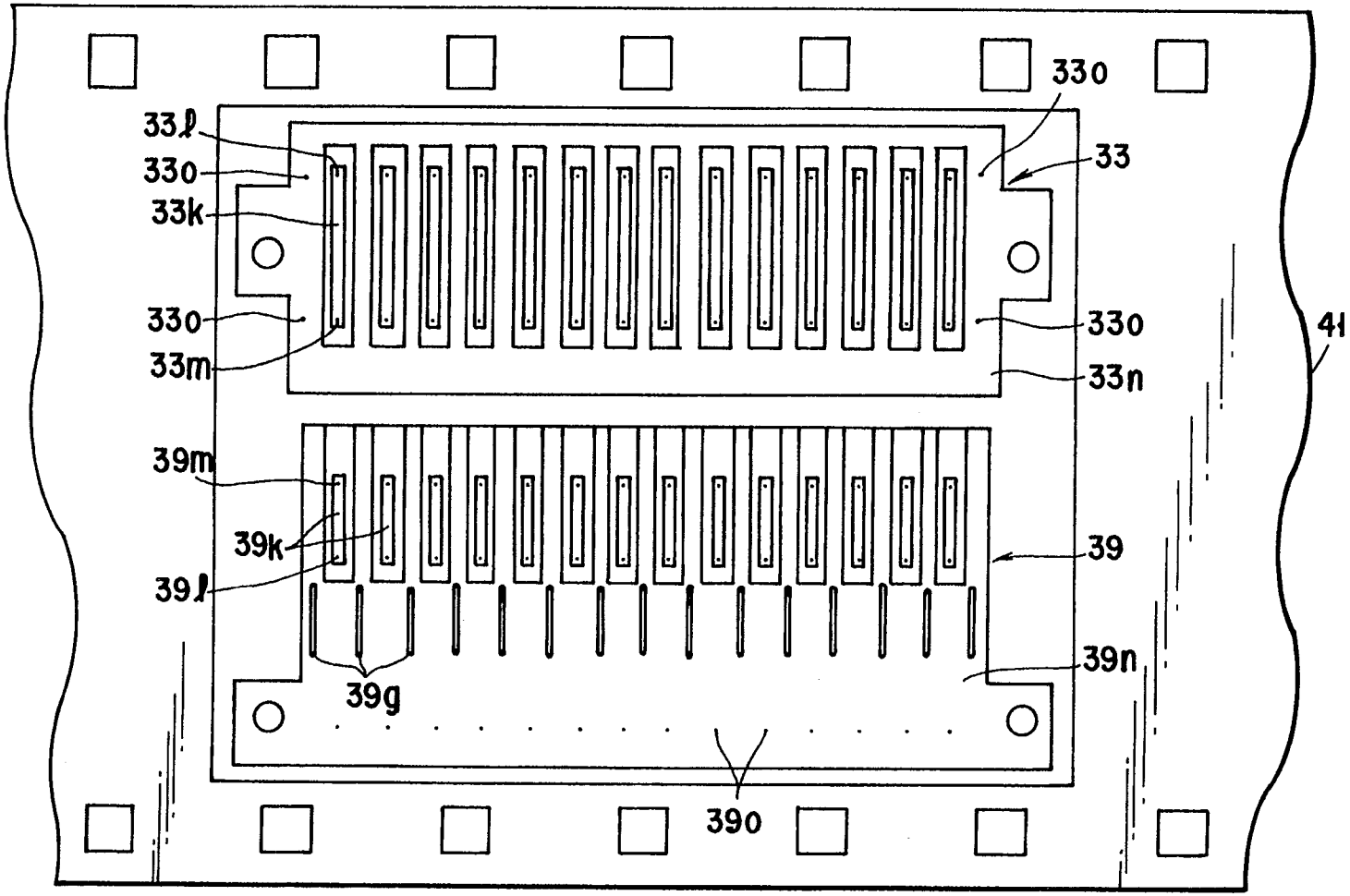
FIG. 7 is a bottom view of a modification of the first and the second contact plate of FIG. 1.

FIGS. 6 and 7 illustrate a modification of the first and second contact members 33 and 39.

FIGS. 6 and 7 show the front and back of TAB tape 41, respectively. In FIG. 6, on the front of TAB tape 41, a plurality of first contact elements 33*h* and 33*i* constituting the first contact member 33 are formed a specified distance apart, and a plurality of second contact elements 39*h* and 39*i* constituting the second contact member 39 are formed a specified distance apart. The flat cable 24 is connected to the first contact elements 33*h*, whereas the printed wiring board 25 is connected to the second contact elements 39*i*.

A first shielding copper foil 33*j* is integrally formed between the first contact elements 33*h* and 33*i* and between first contact elements 33*h* and between the first contact elements 33*i*. Further, a second shielding copper foil 39*j* is integrally from between the second contact element 39*h* and 39*i* and between the second contact elements 39h and between the second contact elements 39i. The slits 39g are made in the second copper foil 39j between the second contact elements 39h.

As shown in FIGS. 6 and 7, a plurality of copper foils 33k are provided on the back of the TAB tape 41 in the positions corresponding to the first contact elements 33h and 33i. One end of each copper foil 33k overlaps with each of the first contact elements 33h, whereas the other end overlaps with each of the first contact elements 33i. Each of the first contact elements 33h is connected to one end of each copper foil 33k via a plated-through hole 33l, whereas each of the first contact elements 33i is connected to the other end of each copper foil 33k via a plated-through hole 33m.

A plurality of copper foils 39k are provided on the back of the TAB tape 41 in the positions corresponding to the second contact elements 39h and 39i. One end of each copper foil 39k overlaps with each of the second contact elements 39h, whereas the other end overlaps with each of the second contact elements 39i. Each of the second contact elements 39h is connected to one end of each copper foil 39k via a plated-through hole 391, whereas each of the second contact elements 39i is connected to the other end of each copper foil 39k via a plated-through hole 39m.

As shown in FIG. 7, a third and a fourth shielding copper foils 33n and 39n are provided around the copper foils 33k and 39k on the back of the TAB tape 41, respectively. These third and fourth copper foils 33n and 39n are connected to the first and second shielding copper foils 33j and 39j via a plurality of plated-through holes 33o and 39o, respectively.

With this configuration, the first contact elements 33h and 33i are surrounded by the first and third copper foils 33j and 33n, respectively, whereas the second contact elements 39h and 39i are enclosed by the second and fourth copper foils 39j and 39n, respectively. This enables the first contact elements 33h, 33i and the second contact elements 39h, 39i to be shielded.

Because the first and second contact elements 33h, 33i, 39h, and 39i are formed on the same TAB tape 41 at a time, their pitch can be maintained at a high accuracy.

While in the embodiment, the first and second contact members 33 and 39 are made of TAB tape, other materials may be used. For instance, the first and second contact members may be printed on a flexible board or the like for the same purposes.

Although the first and second connector sections 22 and 23 adhere to each other by the attractive force of permanent magnets, another approach may be used. For instance, the first and second holders are provided with engaging portions such as claws, which engage with each other to join the first and second holders together.

While the plate 32 is provided with a plurality of through holes 32e, they may be omitted. With the absence of such through holes 32e, the contact pressure between the first and second contact elements 33f and 39f of can be improved.

Figure 8:
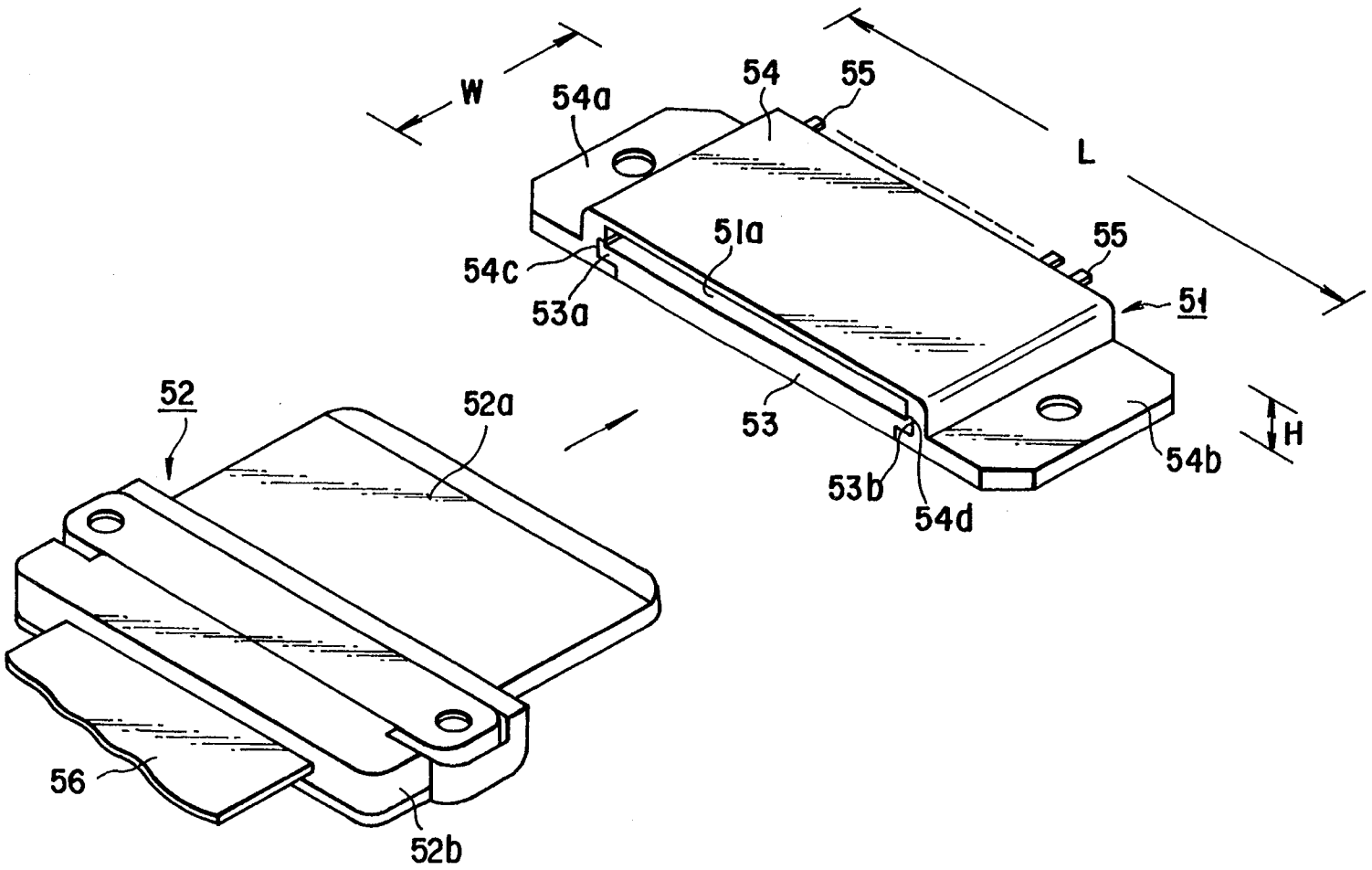
FIG. 8 is a perspective view of a second embodiment of the present invention.

FIG. 8 shows a second embodiment of the present invention. While in the first embodiment, the first and second contact elements are electrically connected to each other by stacking the first and second connector sections, in the second embodiment of FIG. 8, another type of connector device is used which allows a plug 52 to be inserted into a socket 51.

The socket 51 is composed of a board 53 and a cover 54. At the front of the socket 51, an opening 51a is made. The insert portion 52a of the plug 52 is inserted into the opening 51a. Mounting portions 54a and 54b for installation on printed boards or the like are formed on both sides of the socket 51. The mounting portions 54a and 54b are integrally formed with the cover 54. On the back of the socket 51, a plurality of outer leads 55 are provided. The socket 51 has a length L of 20 mm when the number of outer leads 55 is 20 with a pitch of 0.4 mm, a height of 2.0 mm, and a width of 7.5 mm. The body 52b of the plug 52 is provided with a flat cable 56.

Figure 9:
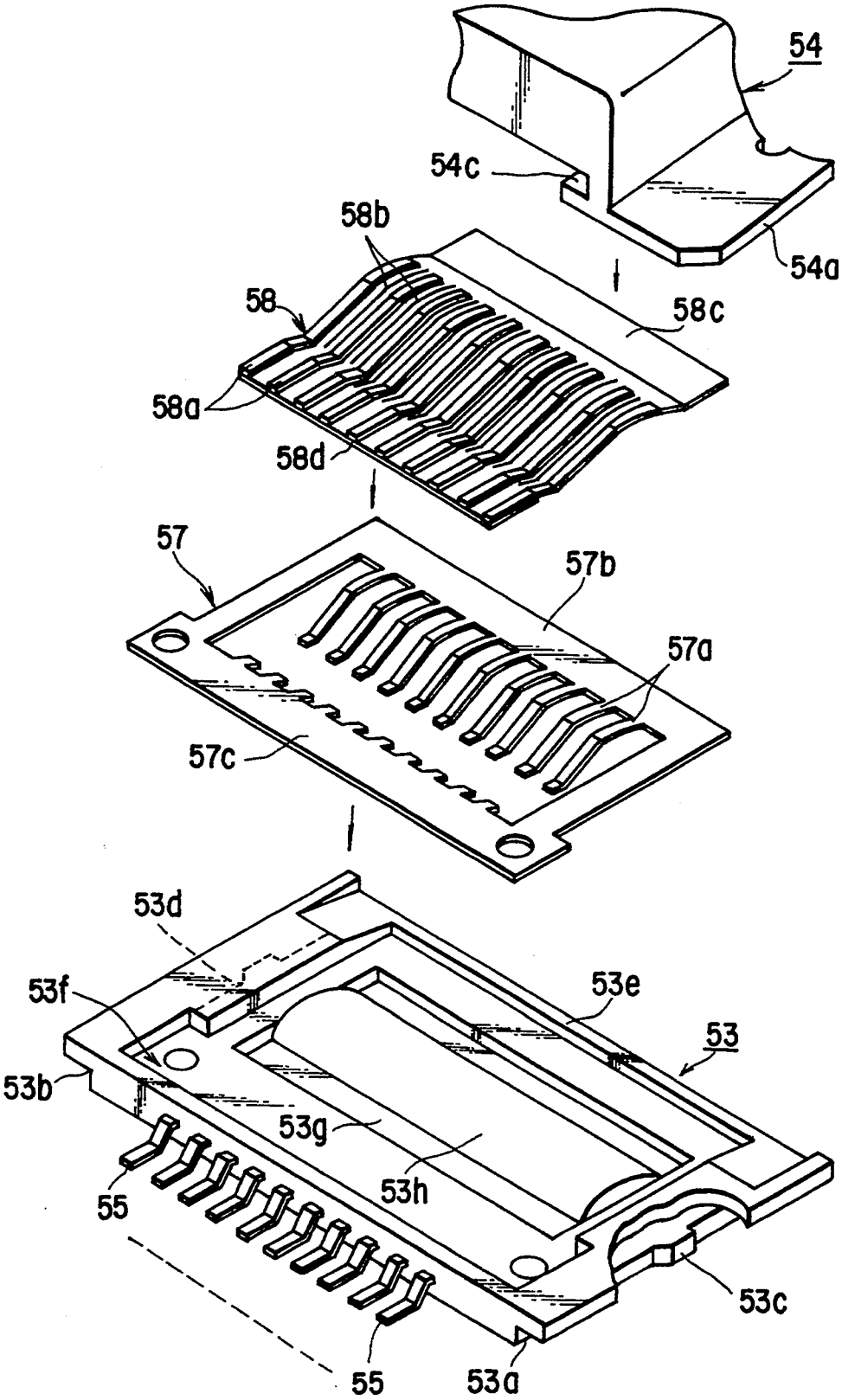
FIG. 9 is an exploded perspective view of the construction of the socket, illustrating a primary portion of FIG. 8.

FIG. 9 illustrates the construction of the socket 51 concretely. At both ends of the board 53 across its length, engaging portions 53a and 53b are formed along its width. Groove portions 54c and 54d are formed in the cover 54 (only 54c is shown in FIG. 9). The engaging portions 53a and 53b of the board 53 are fitted into the groove portions 54c and 54d in the cover 54, and the board 53 is installed in the cover 54. Small projections 53c and 53d are formed on the sides of the engaging portions 53a and 53b, respectively. These projections 53c and 53d are located so as to fit into recessed portions (not shown) in the groove portions 54c and 54d. When the board 53 is installed in the cover 54, the projections 53c and 53d engage with the recessed portions, which prevents the board 53 from coming off from the cover 54.

The board 53 is provided with a slope portion 53e forming the opening 51a. The board 53 is also provided with a housing portion 53f to house a metal frame 57. A recessed portion 53g is formed in the center of the housing section 53f. In the mid section of the recessed portion 53g, a projecting portion 53h is formed along the length of the board 53.

A plurality of springs 57a are integrally formed with the frame 57. One end of each spring 57a is joined to one side of the frame 57, and the other end is left free. The springs are curved so as to be the highest in the center. The frame 57 is provided with, for example, TAB tape 58 constituting the first contact member. As with the first embodiment, the TAB tape 58 is of a two-layer construction of an insulating film and copper foil. On the surface of the TAB tape 58, a plurality of first contact elements 58a of copper foil are fixed. These first contact elements 58a are provided so as to correspond to the springs 57a. Slits 58b are made in the TAB tape 58 between the first contact elements 58a. One end of each of the first contact elements 58a along its length is a specified distance away from one side 58c of the TAB tape 58, whereas the other end agrees with the other side of the TAB tape 58.

Figure 10:
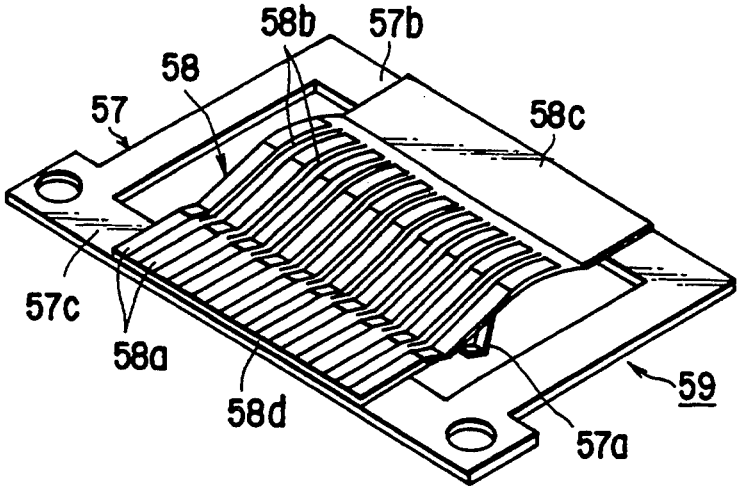
FIG. 10 is a perspective view of the arrangement of the contact device of FIG. 8.

FIG. 10 illustrates the contact device 59 into which the frame 57 and TAB tape 58 are assembled.

One side 58c and the other side 58d of the TAB tape 58 are bonded to one side 57a and the other side 57c of the frame 57, respectively. The width of the TAB tape 58 is made larger than that of the frame 57. As shown in the figure, with the TAB tape 58 bonded to the frame 57, the TAB tape 58 is curved along the springs 57a. The portion from the center to one end of each spring 57a adheres to the TAB tape 58, whereas the portion from the center to the other end is left free.

Figure 11:
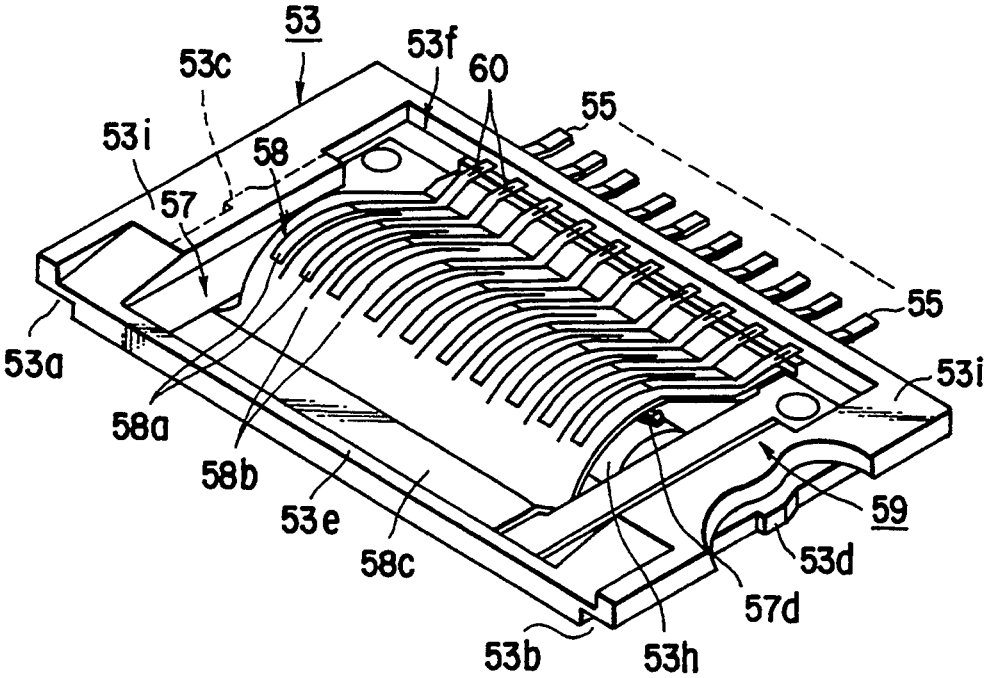
FIG. 11 is a perspective view of the construction of the socket.

FIG. 11 shows the state where the contact device 59 of FIG. 10 is housed in the housing section 53f of the board 53. The contact device 59 is placed with one side 58c of the TAB tape 58 in contact with the slope portion 53e of the board 53. In this state, the other end of the first contact elements 58a are connected to the outer leads 55 projecting into the housing section 53*f* by bonding wires 60.

Figure 12:
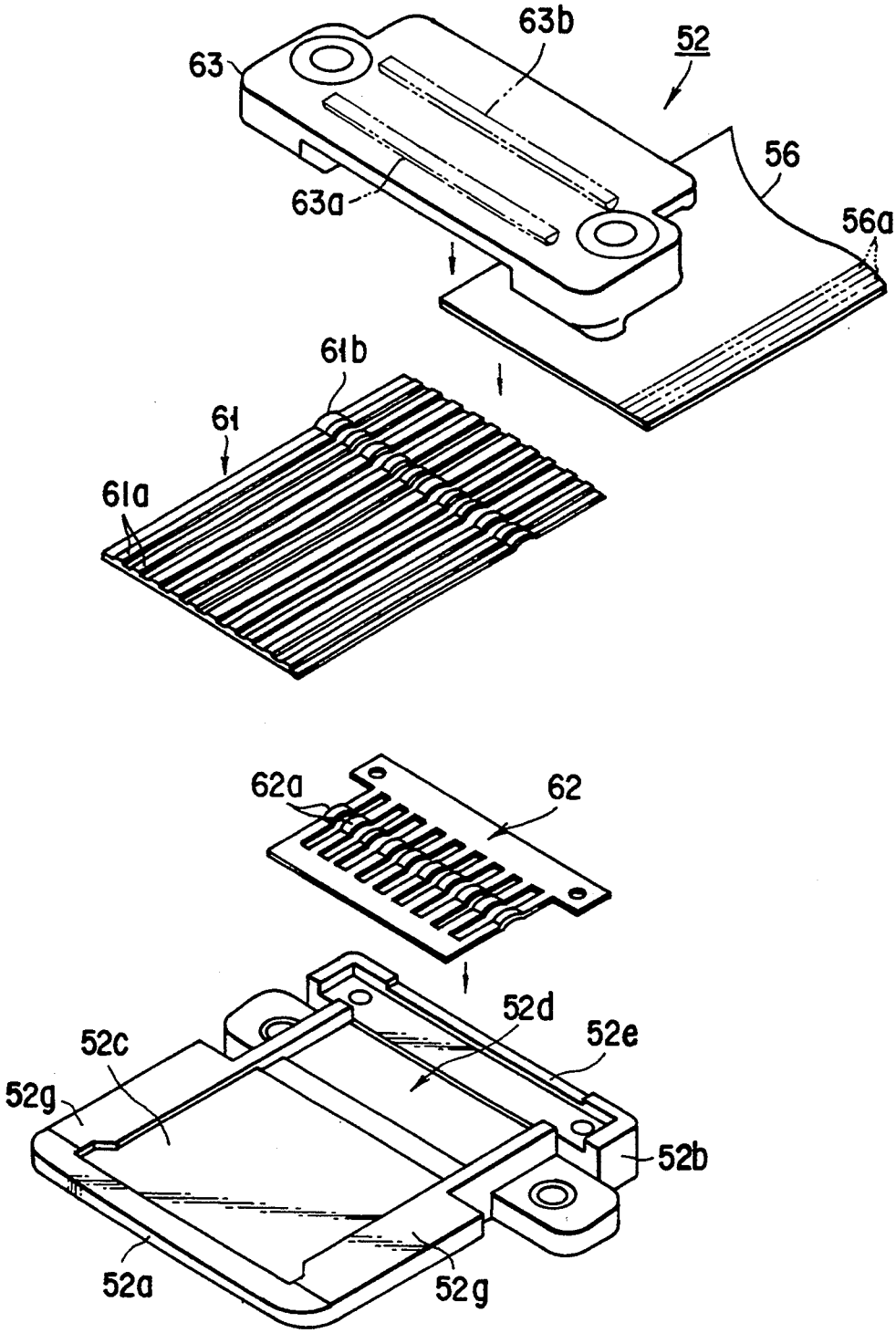
FIG. 12 is an exploded perspective view of the construction of the plug, showing a primary portion of FIG. 8.
Figure 13:
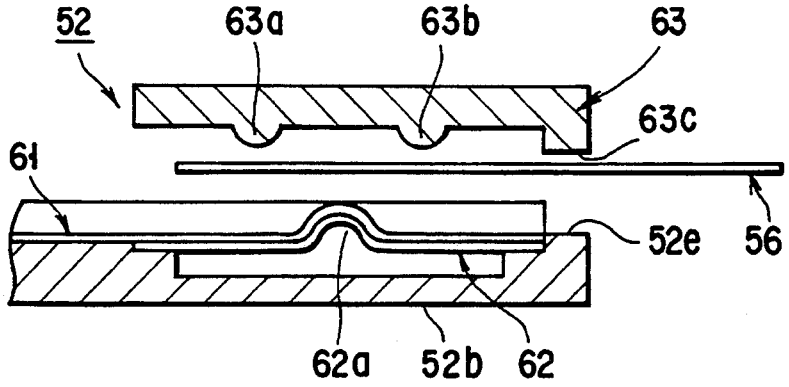
FIG. 13 is a sectional view of the plug, with parts broken away.
Figure 14:
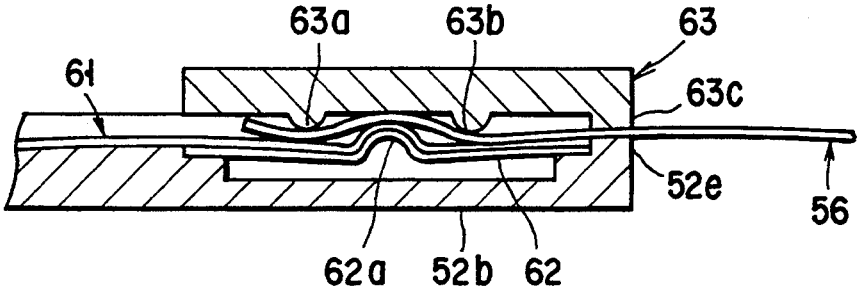
FIG. 14 is a sectional view of the assembled state of FIG. 13.

FIGS. 12 to 14 illustrate the construction of the plug 52 concretely. A first housing section 52*c* is formed in the insert portion 52*a* of the plug 52. In the housing section 52*c*, for example, TAB tape 61 constituting the second contact member is housed. On the surface of the TAB tape 61, a plurality of second contact elements 61*a* of copper foil are patterned. These second contact elements 61*a* are located so as to come into contact with the first contact elements 58*a*, respectively. Curved portions 61*b* are made in part of the second contact elements 61*a*.

In the body 52*b* of the plug 52, a second housing section 52*d* is formed so as to connect with the first housing section 52*c*. The second housing section 52*d*, which is made deeper than the first housing section 52*c*, houses a pressure contact plate 62. The pressure contact plate 62 is provided with pressure contact portions 62*a* so as to correspond to the curved portions 61*b* of the second contact elements 61*a*. The pressure contact plate 62 is bonded to the back of the TAB tape 61 with the pressure contact portions 62*a* aligned with the curved portions 61*b*. In this state, they are housed in the second housing section 52*d*. The remaining portions of the TAB tape 61 are bonded to the first housing section 52*c*.

The flat cable 56 is overlapped with the second contact elements 61*a* so that their leads 56*a* may make contact with the latter. In this state, the cover 63 is attached to the body 52*b*, with the result that the leads 56*a* of the flat cable 56 are pressed against the second contact elements 61*a*, coming into contact with one another. Specifically, two projecting portions 63*a* and 63*b* are formed on the inside of the cover 63. As shown in FIG. 13, these projecting portions 63*a* and 63*b* are arranged so as to make contact with both sides of the curved portions 61*b* of the TAB tape 61. Therefore, when the cover 63 is mounted on the body 52*b*, the leads 56*a* of the flat cable 56 are connected to the second contact elements 61*a* by the action of the projecting portions 63*a* and 63*b* of the cover 63 and the pressure contact portion 62*a* of the pressure contact plate 62, as shown in FIG. 14. The flat cable 56 is clamped between the edge 52*e* of the body 52*b* and the edge 63*c* of the cover 63. This prevents the flat cable 56 from coming off from the plug 52.

Figure 15:
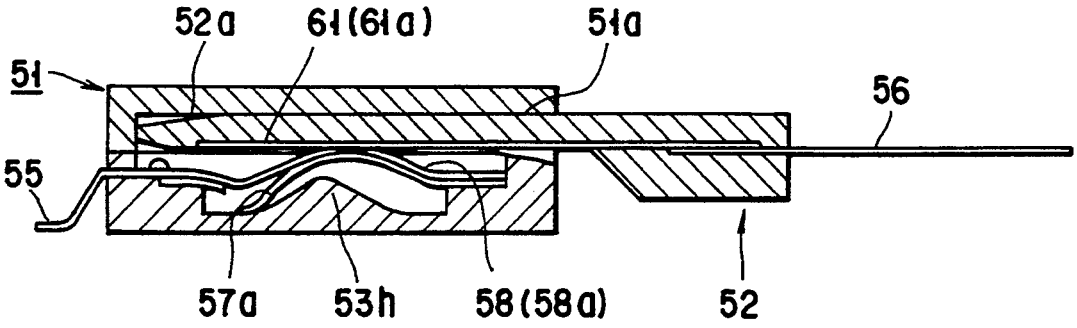
FIG. 15 is a sectional view of the state where the plug is inserted in the socket.

FIG. 15 shows the state where the plug 52 is connected to the socket 51 of the above construction. When the insert portion 52*a* of the plug 52 is inserted into the opening 51*a* of the socket 51 and the tip of the plug 52 comes into contact with the TAB tape 58, the TAB tape 58 is deformed against the urging force of the springs 57*a*. In this state, the plug 52 is inserted further, the tip of the spring 57*a* moves along the projecting portion 53*h*, which permits the TAB tape 58 to be deformed further. As the plug 52 is inserted further, the second contact elements 61*a* of the plug 52 slide while staying in contact with the first contact elements 58*a* (not shown). With the plug 52 fully inserted in the socket 51 as shown in FIG. 15, the first contact elements 58*a* are brought into contact with the second contact elements 61*a* by the stress of the TAB tape 58 and the urging force of the springs 57*a*.

With the second embodiment, the contact device 59 composed of the TAB tape 58 with the first contact elements 58*a* and the frame 57 to support them is provided in the socket 51, and the TAB tape 61 with the second contact elements 61*a* is provided in the plug 52. Therefore, it is possible to construct an ultra-compact connector device of a type that allows insertion of the plug into the socket.

The TAB tape 58 is curved and attached to the frame 57. The height of the plurality of springs 57*a* bonded to the frame 57 is made larger than that of the curved TAB tape 58. Because of this, when the TAB tape 58 is attached to the frame 57, the plurality of springs 57*a* are pressed against the TAB tape 58. As a result, the TAB tape 58 makes the springs 57*a* the same height after the assembly, even if the springs 57*a* were somewhat different in height. Since the size of the plurality of springs 57*a* bonded to the frame 57 is very fine, the above construction facilitates the manufacture of springs 57*a*.

Because the plurality of springs 57*a* are covered with the TAB tape 58, an external force exerted on the TAB tape is distributed to the plurality of springs 57*a*. Therefore, during the insertion of the plug 2, the springs 57*a* are prevented from being deformed so heavily that they cannot return, which enables the construction of a strong contact device.

The TAB tape 58 is curved and attached to the frame 57, which makes the first contact elements 58*a* the same height. As the plug is inserted further, this deforms the TAB tape 58, which creates a specific stress together with the urging force of the springs 57*a*. As a result, the first contact elements 58*a* are in contact with the second contact elements 61*a* more reliably.

The portion from one end to the center of each spring 57*a* adheres to the TAB tape 58. This prevents the misalignment of the springs 57*a* and the first contact elements 58*a*, thereby maintaining the pitch between the first contact elements 58*a* accurately.

The slits 58*b* are made in the TAB tape 58 between the first contact elements 58*a*. The slits 58*b* enable the plurality of first contact elements 58*a* to operate independently. Specifically, the first contact elements 58*a* are somewhat different in height due to the thickness of adhesive that bonds the TAB tape 58 to the plurality of springs 57*a* and other factors. Similarly, the second contact elements 61*a* are somewhat different in height due to the thickness of adhesive that bonds the plug 52 to the TAB tape 6 and other factors. For this reason, if there is no slit 58*b* in the TAB tape 58, the first contact elements come into contact with the second contact elements 61*a* with varied contact pressures, depending on the height and action of the adjacent first contact elements. Therefore, when an external vibration is applied, the contact sometimes can become unstable. As with the present embodiment, by making each of the first contact elements 58*a* independent with slits 58*b*, each first contact element is not affected by the height and action of the adjacent first contact elements. As a result, the contact pressure between the respective first contact elements 58*a* and the respective second contact elements 61*a* can be made constant, thereby improving the stability of the contact.

If the first and second contact elements 58*a* and 61*a* can be made the same height, the slits 58*b* may be omitted.

Each spring 57*a* comes into contact with the projecting portion 53*h* on the board 53, sliding over the surface of the projecting portion 53*h*, as the plug 52 is inserted further. This makes it possible to equalize the contact pressure between the respective first contact elements 58*a* and the respective second contact elements 61*a*.

Further, the TAB tape 61 with the second contact elements 61*a* and the flat cable 56, which constitute the plug 52, are connected to each other by pressing against one another with the pressure contact plate 62 and the projecting portions 62*a* and 63*b* on the cover 63. This allows the plurality of fine second contact elements 61*a* to easily connect to the leads 56*a* of the flat cable 56.

When sufficient elasticity can be obtained with the TAB tape 58 curved, the frame 57 to support the TAB tape 58 and the plurality of springs 57*a* bonded to the frame 57 may be omitted.

While in the embodiment, the contact member 58 is made of TAB tape, other materials may be used. For instance, the contact member may be printed on a flexible board or the like for the same purposes.

Figure 16:
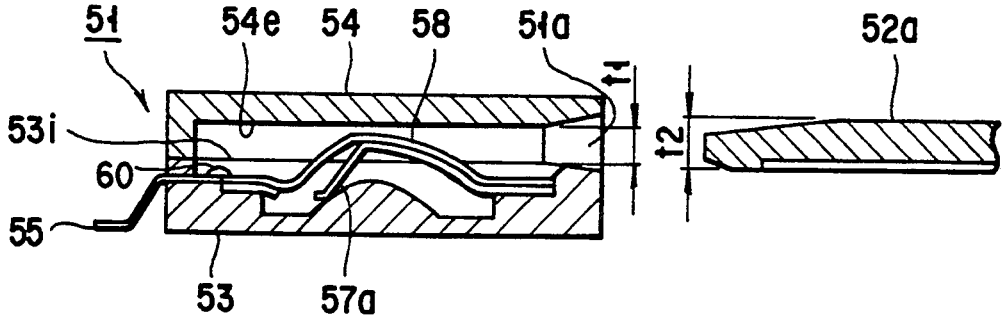
FIG. 16 is a sectional view of the state where the plug is removed from the socket, showing the profile relationship between the socket and plug.
Figure 17:
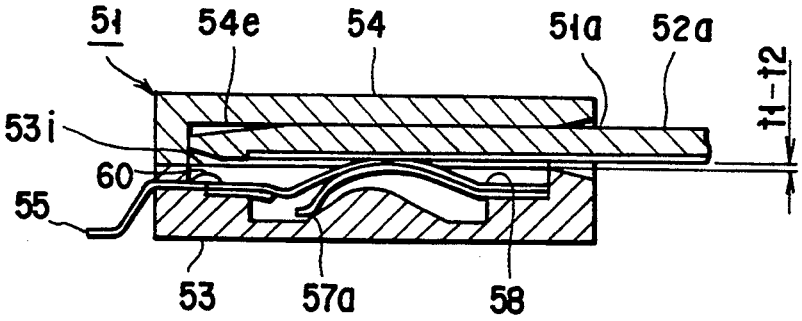
FIG. 17 is a sectional view of the state where the plug is inserted in the socket, showing the profile relationship between the socket and plug.
Figure 18:
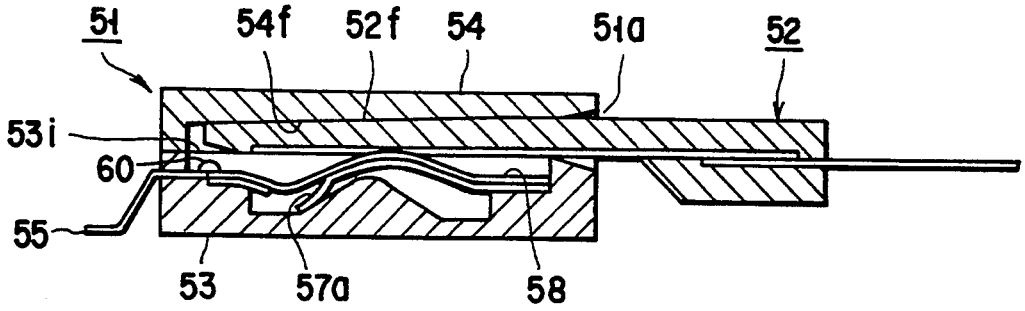
FIG. 18, which is concerned with a third embodiment of the present invention, is a sectional view of the state where the plug is inserted in the socket.

FIGS. 16 to 18 show a third embodiment of the present invention. This embodiment is associated with the prevention of the plug 52 inserted in the socket 51 from coming off.

As shown in FIG. 16, the portion into which the plug 52 of the socket 51 is inserted is connected to an opening 51*a* and located between the inside 54*e* of the cover 54 and the top surface 53*i* of the board 53 (also shown in FIG. 11). The inside 54*e* of the cover 54 and the top surface 53*i* of the board 53 are made parallel with each other, and the distance t1 between them is set somewhat larger than the thickness t2 of the insert portion 52*a* of the plug 52. As a result, when the plug 52 is inserted into the socket 51 as shown in FIG. 17, there is a clearance of t114 t2 between the plug 52 and the top surface 53*i* of the board 53.

When there is such a clearance, the adhesive properties of the first and second contact elements are so poor that the contact between them can be unstable. with the plug 52 inserted in the socket 51, the urging force of the springs 57*a* and the stress of the TAB tape 58 press the plug 52 against the inside 54*e* of the cover 54. This contact pressure prevents the plug 52 from coming off from the socket 51. When the number of springs 57*a* is small, it may be difficult to press the plug 52 against the inside 54*e* of the cover 54 with sufficient force.

To overcome this problem, in the present embodiment, the slope portion 54*f* is provide on the inside 54*e* of the cover 54 as shown in FIG. 18. Thus, the distance between the inside 54*e* of the cover 54 and the top surface 53*i* of the board 53 is gradually narrower from the opening 51*a* inward. In addition, the slope portion 52*f* is formed on the surface of the insert portion 52*a* of the plug 52 so that the insert portion 52*a* may become thinner toward the tip.

With the third embodiment, when the plug 52 is inserted into the socket 51, the front (the slope portion 52*f*) of the plug 52 is pressed against the slope portion 54*f* of the cover 54, whereas the back of the plug 52 (52*g* in FIG. 12) is pressed against the top surface 53*i* of the board 53. This eliminates a clearance between the plug 52 and the socket 51, which improves the adhesive properties of the first and second contact elements, thereby maintaining the stability of the contact.

The plug 52 is pressed against the slope portion 54*f* of the cover 54 and the top surface 53*i* of the board 53, and pressed toward the slope portion 54*f* of the cover 54 by the springs 57*a*. As a result, the plug 52 is held within the socket 51 with sufficient force.

Figure 19:
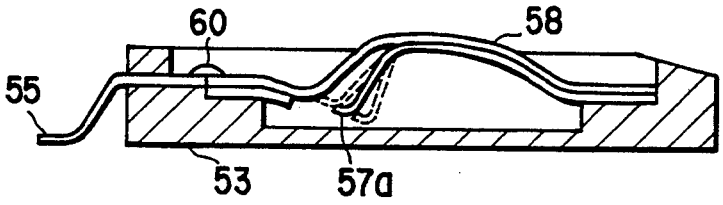
FIG. 19 is a sectional view of an important portion of the springs installed to the contact member, with a view to explaining the spring's urging force.
Figure 20:
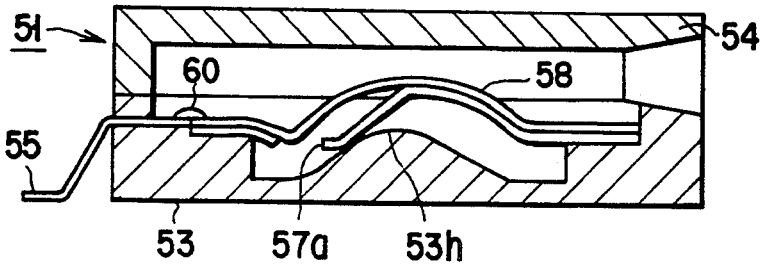
FIG. 20, which is connected with a fourth embodiment of the present invention, is a sectional view of a configuration that allows setting of the spring's urging force.
Figure 21:
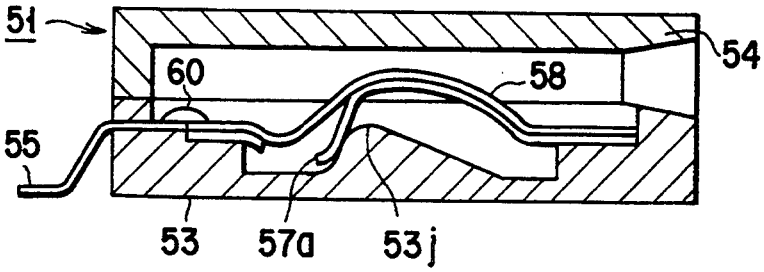
FIG. 21, which is connected with the fourth embodiment, is a sectional view of another configuration that allows setting of the spring's urging force.

FIGS. 19 to 21 show a fourth embodiment of the present invention. This embodiment is associated with the construction of setting the urging force of the springs 57*a* bonded to the frame 57.

The bending angle of each spring 57*a* bonded to the frame 57 is not constant but somewhat different from each other as shown by broken lines in FIG. 19. For this reason, in the second embodiment, the projecting portion 53*h* is formed on the board 53 to make the urging force of each spring 57*a* the same, as shown in FIG. 20. The urging force of each spring 57*a* can be set as needed by changing the shape of the projecting portion 53*h*.

In FIG. 21, a projecting portion 53*j* is formed on the board 53. The projecting portion 53*j* has a shaper slope with which the springs 57*a* make contact than that of the projecting portion 53*h* in FIG. 20. With the present embodiment, the urging forces of the springs 57*a*, therefore, become stronger than the construction of FIG. 20, thus improving the contact pressure between the first and second contact elements.

Figure 22:
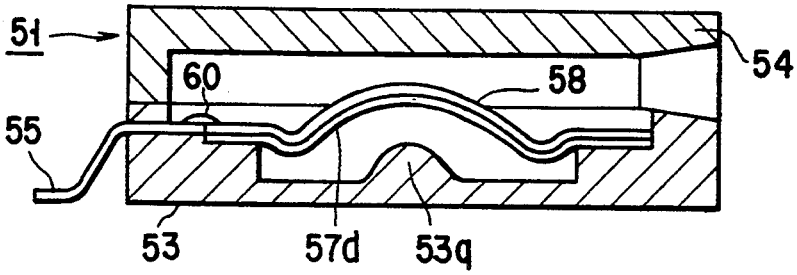
FIG. 22, which is related to a fifth embodiment of the present invention, is a sectional view of a configuration that allows setting of the spring's urging force.

FIG. 22 shows a fifth embodiment of the present invention. In the second to fourth embodiments, one end of each spring 57*a* is integrally formed with the frame 57, and the other end is left free. In the present embodiment, as shown in FIG. 22, one end and the other end of each spring 57*d* are integrally formed with the frame 57, and the entire spring 57*d* is bonded to the TAB tape 58. A projecting portion 53*q* is formed on the board 53 so as to correspond to the curved portion of the spring 57*d*. The projecting portion 53*q* prevents the spring 57*d* and TAB tape 58 from warping longitudinally. With this embodiment, the simple shape of the springs 57*d* facilitates the manufacture.

FIGS. 23 to 28 show a sixth embodiment of the present invention. The same parts as those in the second to fourth embodiments are indicated by the same reference characters. The present embodiment is concerned with a lock mechanism that locks the plug inserted in the socket, and a mounting member for mounting the socket on, for example, a printed wiring board.

Figure 23:
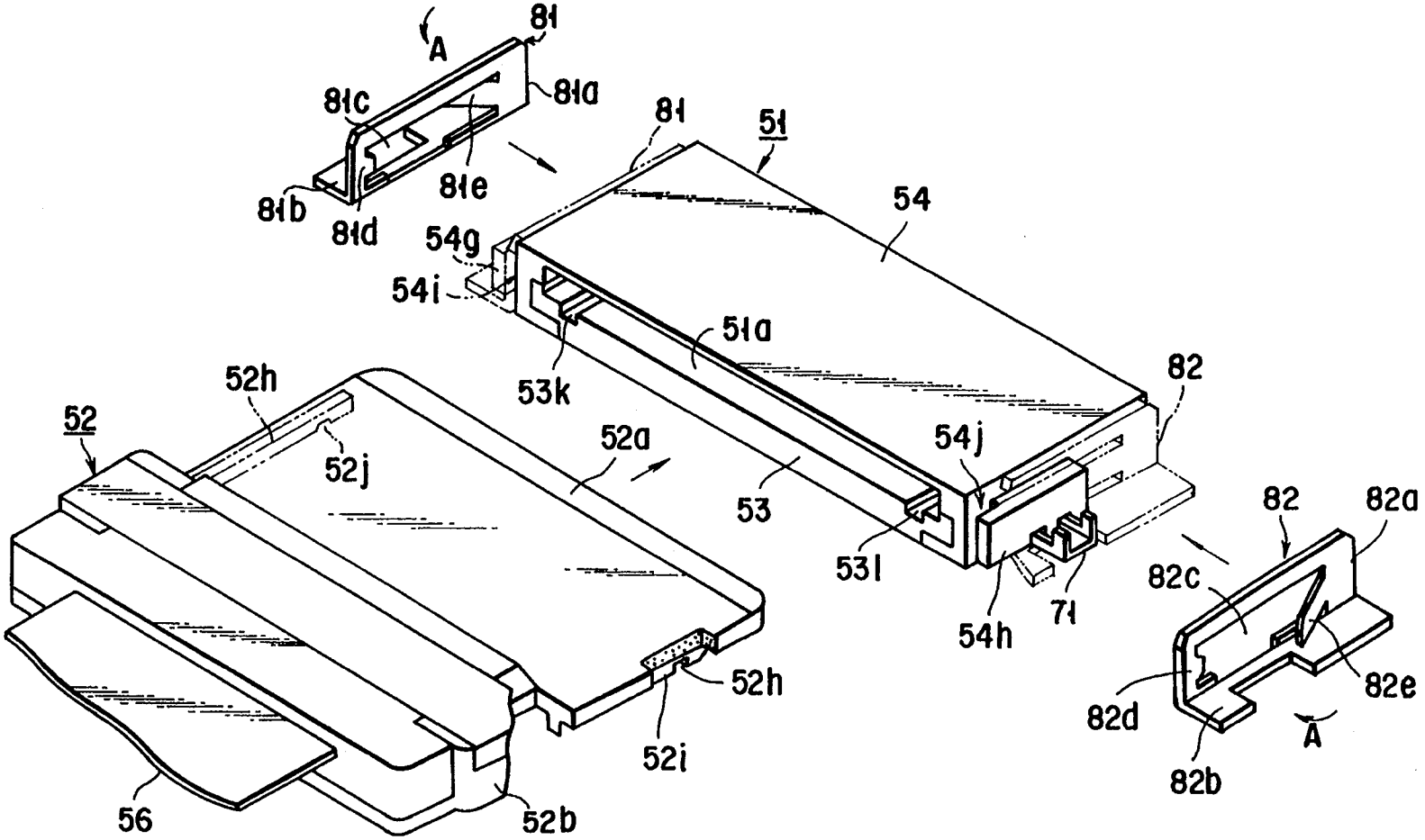
FIG. 23 is an exploded perspective view of a sixth embodiment of the present invention.

The lock mechanism will be first explained. As shown in FIG. 23, rails 52*h* and 52*i* serving as first guide members are provided in the insert direction on the back of the insert portion 52*a* of the plug 52. In part of the rails 52*h* and 52*i*, first engaging portions 52*j* and 52*k* of, for example, recessed portions are formed. In the board 53, groove portions 53*k* and 53*l* serving as second guide members are formed so as to correspond to the rails 52*h* and 52*i*.

Figure 24:
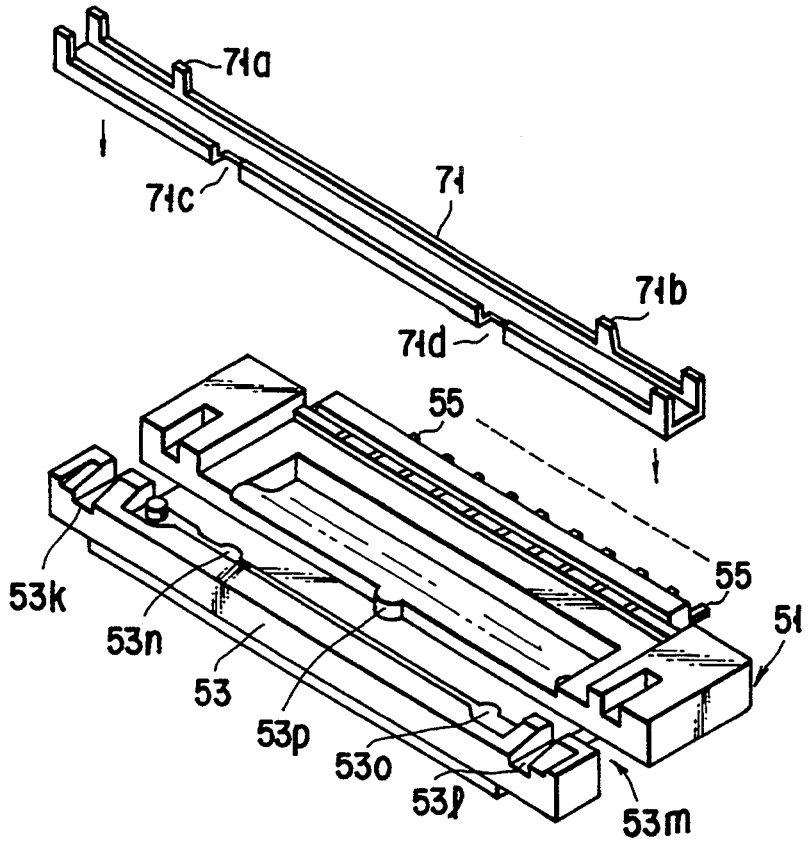
FIG. 24 is an exploded perspective view of a primary portion of the lock mechanism of FIG. 23.

FIG. 24 shows the construction of the board 53. In the board 53, a groove portion 53*m* is formed in the direction perpendicular to the groove portions 53*k* and 53*l*, that is, across the length of the board 53. In the groove portion 53*m*, a slide member 71 is placed so as to slide freely. The slide member 71 is provided with second engaging portions 71*a* and 71*b* composed of, for example, a pair of projecting portions, so as to correspond to the groove portions 53*k* and 53*l*. On one side of the groove portion 53*m*, third engaging portions 53*n* and 53*o* made up of, for example, projecting portions, are formed a specified distance apart to limit the movement range of the slide member 71. In the slide member 71, fourth engaging portions 71*c* and 71*d* made up of, for example, recessed portions, are formed so as to engage with the third engaging portions 53*n* and 53*o*, respectively. Further, on the other side of the groove portion 53*m*, a projecting portion 53*p* is formed so as to press the slide member 71 toward the third engaging portion 53*n* and 53*o*.

Figure 25:
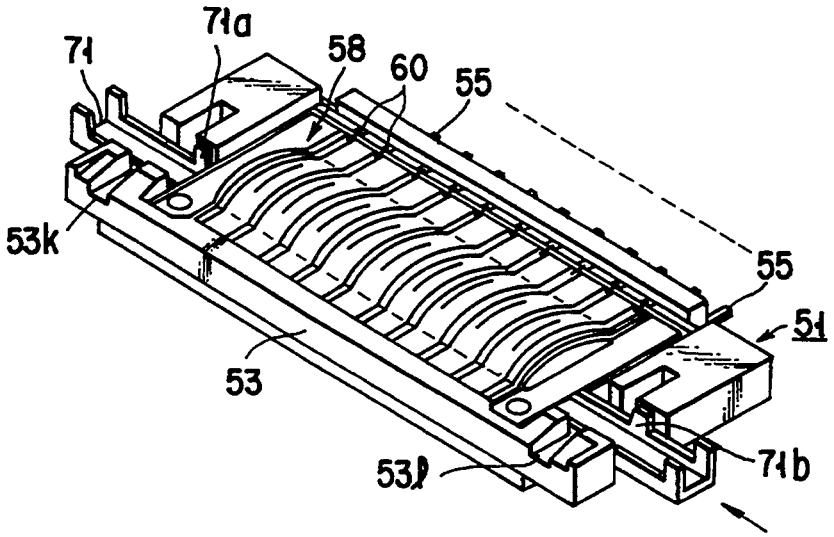
FIG. 25 is a perspective view of the operation of the lock mechanism of FIG. 23.
Figure 26:
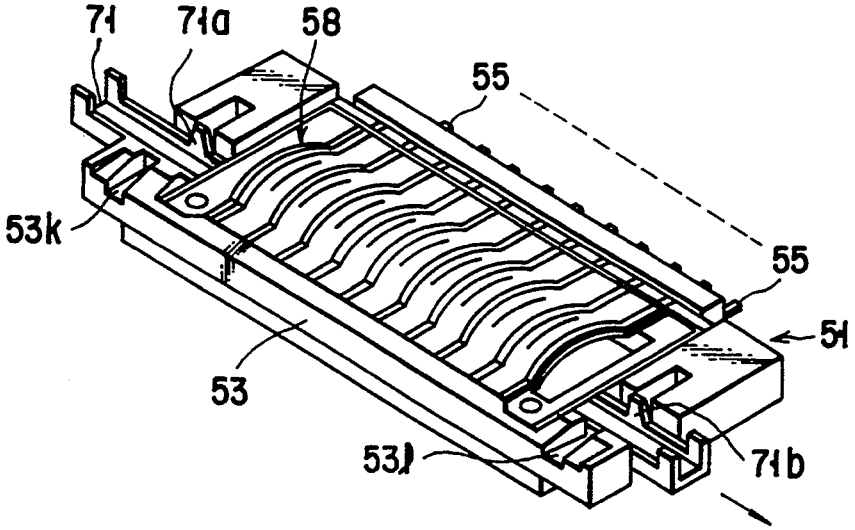
FIG. 26 is a perspective view of the operation different from that of FIG. 25.
Figure 27A:
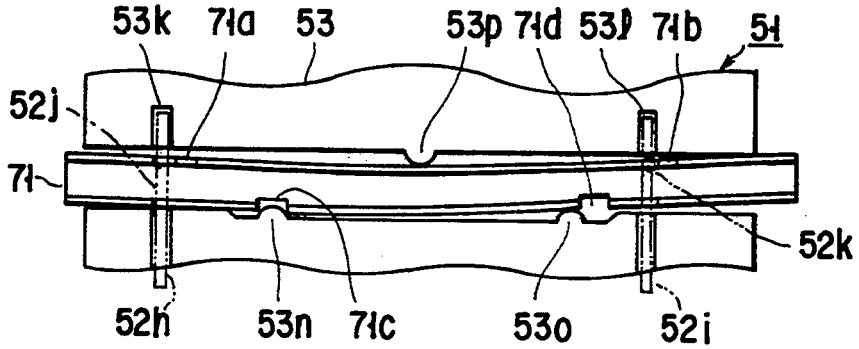
FIGS. 27A and 27B show the operation of the lock mechanism, each being a plan view of an operating states.

FIGS. 25 to 27A and 27B each illustrate different operating positions of the slide member 71. FIGS. 25 and 27A show the lock released position. Specifically, the pair of second engaging portions 71*a* and 71*b* of the slide member 71 is outside the groove portions 53*k* and 53*l*. At this time, the fourth engaging portion 71*c* of the slide member 71 is engaged with the third engaging portion 53*n* of the board 53, which holds the slide member 71 in the lock release position. In this state, when the plug 52 (not shown) is inserted into the socket 51, the rails 52*h* and 52*i* of the plug 52 go into the groove portions 53*k* and 53*l*. In this case, since the first engaging portions 52*j* and 52*k* of the plug 52 have not been engaged with the second engaging portions 71*a* and 71*b* of the slide member 71, the plug 52 can be pulled apart from the socket 51.

Figure 27B:
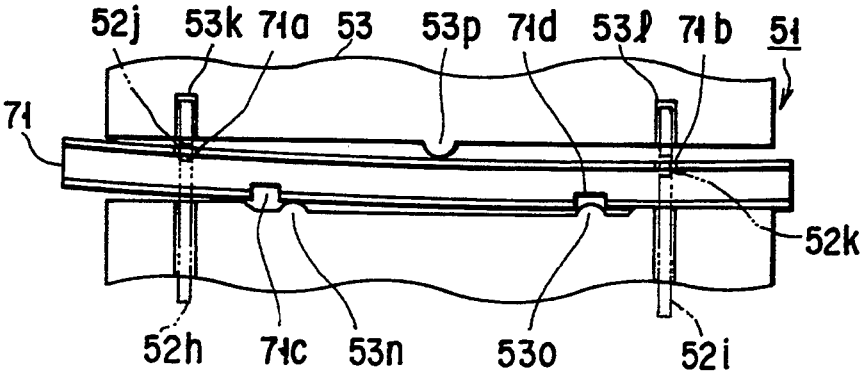

With the plug 52 inserted in the socket 51, when the slide member 71 is moved in the direction of the arrow in FIG. 25, the pair of the second engaging portions 71*a* and 71*b* of the slide member 71 is located in the groove portions 53*k* and 53*l* and in the first engaging portions 52*j* and 52*k* formed in the rails 52*h* and 52*i* as shown in FIGS. 26 and 27B. Because the first engaging portions 52*j* and 52*k* are engaged with the second engaging portions 71*a* and 71*b*, respectively, the plug 52 is held in the socket 51. At this time, the fourth engaging portion 71*d* of the slide member 71 is engaged with the third engaging portion 53*o* of the board 53, which holds the slide member 71 in the locked position.

With the lock mechanism, the first engaging portions 52*j* and 52*k* formed in the plug 52 can be engaged with the second engaging portions of the slide member 71 formed on the board 53. This assures that the plug 52 inserted in the socket 51 is prevented from coming off.

The fourth engaging portions 71*c* and 71*d* of the slide member 71 can be engaged with the third engaging portions 53*n* and 53*o* of the board. This assures that the slide member 71 is held in the lock released position or the locked position, which makes it easy to insert the plug 52 into or pull it out from the socket 51 when the slide member 71 is in the lock released position. When the slide member is in the locked position, the plug 52 can be held securely in the socket 51. The locked state and lock released state will not change easily due to ordinary vibrations.

Explanation will be given about the mounting member used in mounting the socket on, for example, a printed wiring board.

As shown in FIG. 23, at both ends of the cover 54 across its length, hooks 54*g* and 54*h* are provided. Metal mounting members 81 and 82 are attached to the hooks 54*g* and 54*h*. The mounting members 81 and 82 are used to mount the socket 51 horizontally on the printed wiring board. Mounting horizontally here means that mounting the socket 51 so that the opening 51*a* of the socket 51 may point in the direction parallel to the surface of the printed-wiring board.

Specifically, those mounting members 81 and 82 are bend to an angle of 90° across their length to provide faces 81*a* and 82*a* and another faces 81*b* and 82*b*. Openings 81*c* and 82*c* into which the hooks 54*g* and 54*h* are fitted are made in the faces 81*a* and 82*a* of the mounting member 81 and 82. On one inner side of each of openings 81*c* and 82*c*, projecting portions 81*d* and 82*d* to be engaged with the recessed portions 54*i* and 54*j* of the hooks 54*g* and 54*h* are formed, whereas on the other inner side, pressure contact portions 81*e* and 82*e* to press the outer face of the hooks 54*g* and 54*h* are formed. With the mounting members 81 and 82 fixed into the hooks 54*g* and 54*h* as shown by broken lines in FIG. 23, those pressure contact portions 81*e* and 82*e* are bent in the direction of arrow A, so that their tips are pressed against the outer faces of the hooks 54*g* and 54*h*. As a result, the mounting members 81 and 82 are secured to the hooks 54*g* and 54*h*. In this state, the other faces 81*b* and 82*b* of the mounting members 81 and 82 are secured to the printed-wiring board (not shown).

Figure 28:
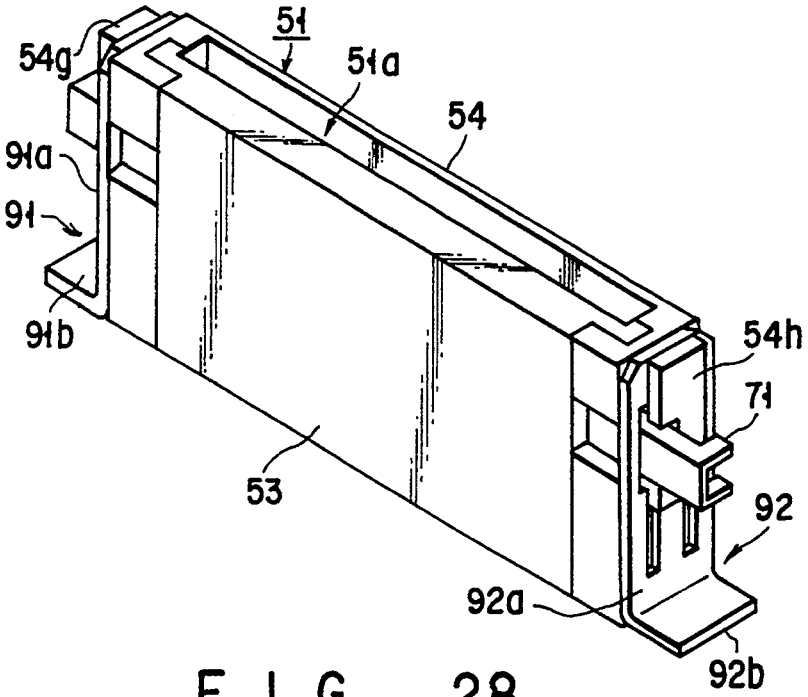
FIG. 28 is a perspective view of the structure of the mounting member.

FIG. 28 shows another embodiment of the mounting members. Mounting members 91 and 92 are used to mount the socket 51 vertically on the printed-wiring board. Mounting vertically here means that the socket 51 is mounted so that its opening 51*a* may point in the direction perpendicular to the surface of the printed-wiring board. The mounting members 91 and 92 are bent to an angle of 90° in the direction perpendicular to their length. Their shape is the same as that of the mounting members 81 and 82 except that faces 91*a* and 92*a* and another faces 91*b* and 92*b* are formed.

The mounting members 81, 82, 91, and 92 thus constructed are attachable to the hooks 54*g* and 54*h* of the cover 54. Therefore, by attaching those mounting members 81, 82, 91, and 92 to the cover 54 as necessary, the socket 51 can be mounted on the printed wiring board horizontally or vertically.

Since just exchanging the mounting members allows the socket 51 to be converted between a horizontal type and a vertical type, it is not necessary to produce two types of sockets 51, horizontal and vertical, which helps reduce the production cost.

FIGS. 29 to 32 illustrate a seventh embodiment of the present invention, which is associated with a connector device with contacts for two systems.

Figure 29:
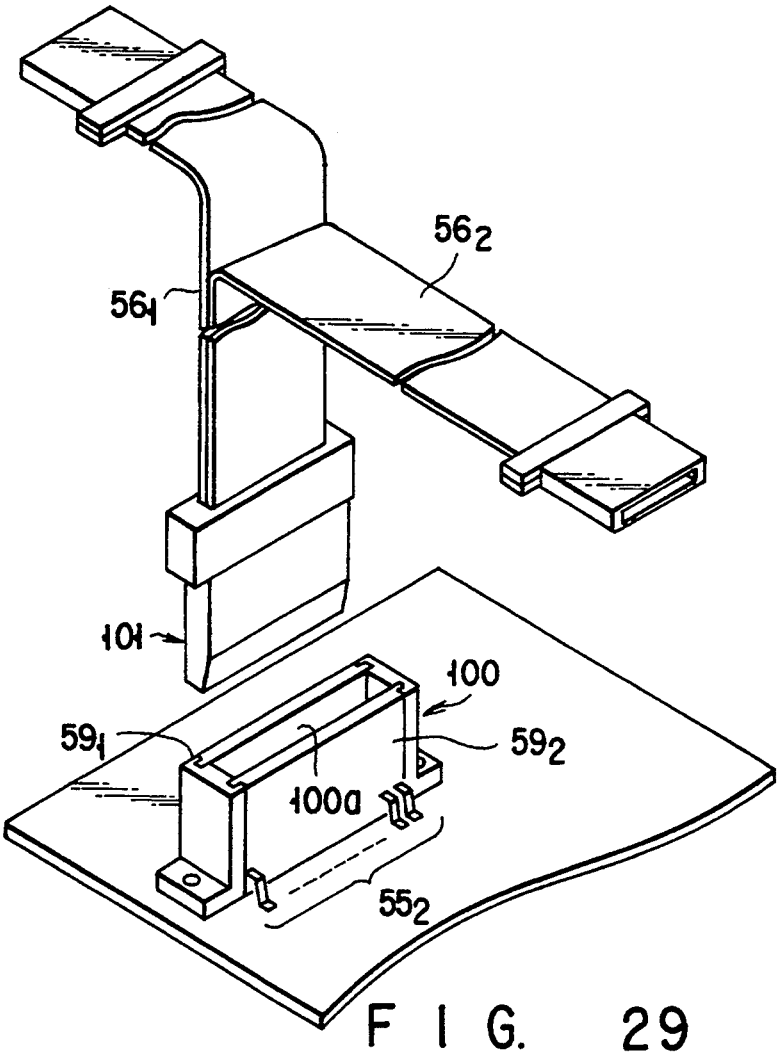
FIG. 29, which is associated with a seventh embodiment of the present invention, is an exploded perspective view of a connector device with contacts for two systems.
Figure 30:
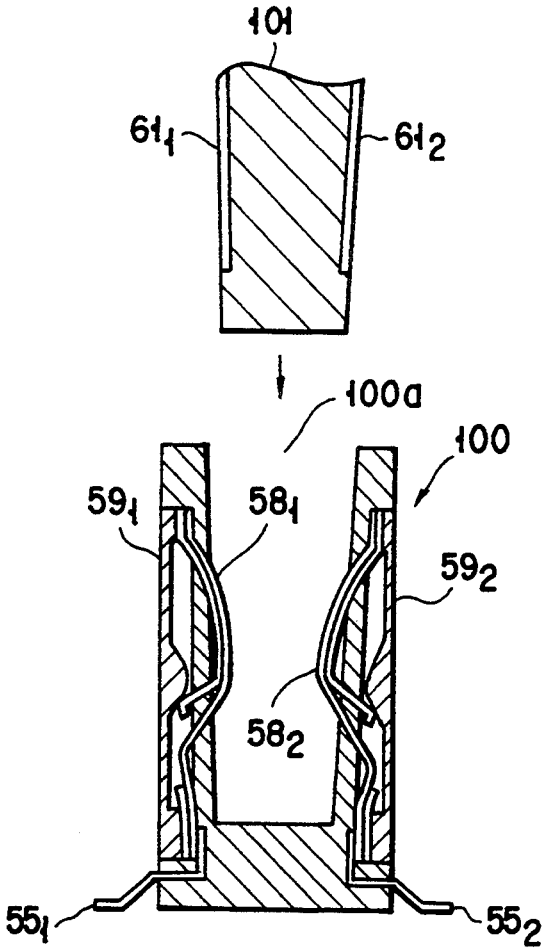
FIG. 30 is a sectional view of the configuration of the socket and plug of FIG. 29.

In FIGS. 29 and 30, an opening 100*a* is made in the socket 100. Inside the socket 100, a pair of contact devices $59_1$ and $59_2$ are provided. These contact devices $59_1$ and $59_2$ have the same construction as that of the contact device shown in FIGS. 9 to 11. TAB tapes $58_1$ and $58_2$ with a plurality of first contact elements (not shown) provided for the contact devices $59_1$ and $59_2$ are arranged so as to face each other. The outer leads $55_1$ and $55_2$ of the contact devices $59_1$ and $59_2$ are provided on both sides of the socket 100.

On the other hand, on both sides of the plug 101, TAB tape $61_1$ and $61_2$ with a plurality of second contact elements (not shown) are provided. With the plug 101 inserted in the opening 100*a*, the second contact elements of the TAB tape $61_1$ and $61_2$ make contact with the first contact elements of the contact device $59_1$ and $59_2$.

Figure 31:
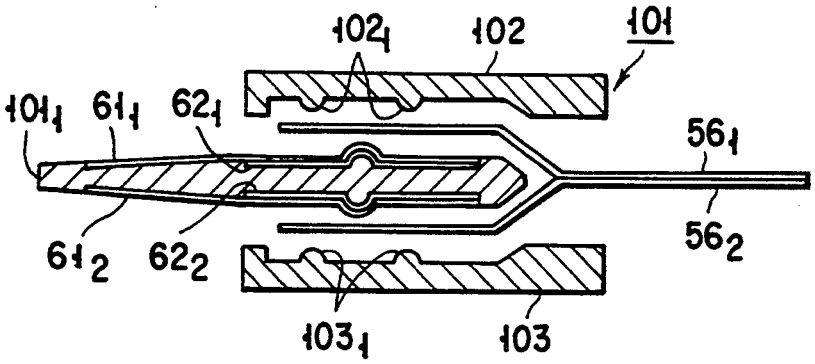
FIG. 31 is an exploded sectional view of the construction of the plug of FIG. 29.

FIG. 31 shows the construction of the plug 101. The plug 101 has almost the same construction as that of the plug 52 of FIG. 12. Specifically, on the backs of the TAB tapes $61_1$ and $61_2$, metal plates $62_1$ and $62_2$ with curved portions are provided. These TAB tapes $61_1$ and $61_2$ are bonded to the front and back of the plug body $101_1$, respectively. One end of the flat cables $56_1$ and $56_2$ is brought into contact with the second contact elements (not shown) of the TAB tapes $61_1$ and $61_2$. In this state, the covers 102, 103 are attached to the plug 101. These covers 102 and 103 are provided with projecting portions $102_1$ and $103_1$. The projecting portions $102_1$ and $103_1$ cause the flat cables $56_1$ and $56_2$ to be pressed against the second contact elements (not shown) of the TAB tapes $61_1$ and $61_2$, respectively.

With the present embodiment, the socket 100 is provided with the pair of contact devices $59_1$ and $59_2$ having the first contact elements, whereas the second contact elements are provided on both sides of the plug 101. This allows a lot of the first and second contact elements to connect with each other at a time.

Figure 32A:
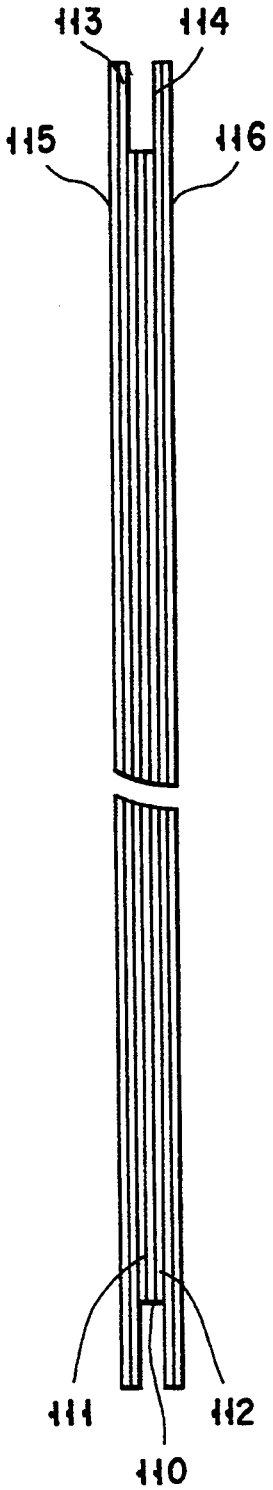
FIGS. 32A and 32B are side views of the arrangement of flat cables for use in the seventh embodiment.
Figure 32B:
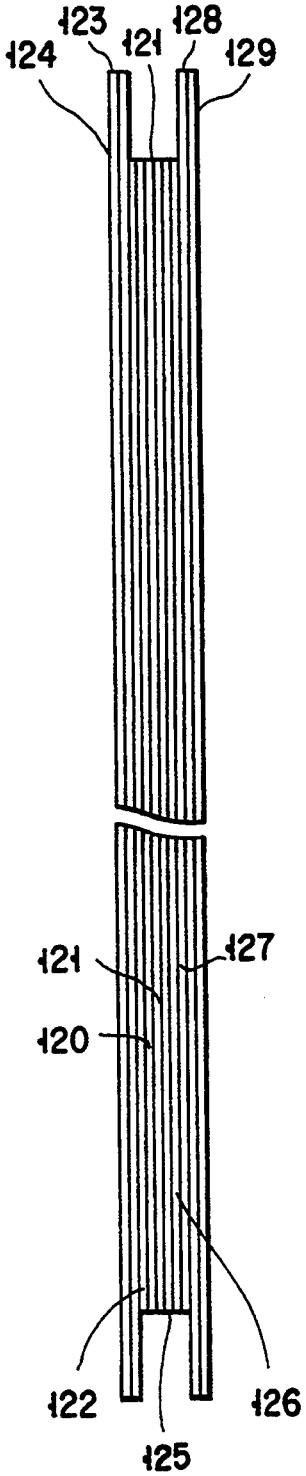

FIGS. 32A and 32B show the construction of the flat cable applied to the embodiment. In FIG. 32A, insulating films 115 and 116 with wiring patterns 113 and 114 are bonded to both sides of an insulating film 110 with adhesives 111 and 112. The wiring pattern 113 is insulated from the wiring pattern 114 with the insulating film 110. The wiring pattern 113 is covered with the insulating film 115, and the wiring pattern 114 is covered with the insulating film 116.

FIG. 32B shows the construction of the flat cable including shielding wires. Specifically, a wiring pattern 121 constituting shielding wires is provided on one side of an insulating film 120. To the other side of the insulating film 120, an insulating film 124 with a wiring pattern 123 is bonded with an adhesive 122. To one side of the insulating film 120, an insulating film 126 is bonded with an adhesive 125. To the insulating film 126, an insulating film 129 with a wiring pattern 128 is bonded with an adhesive 127. With this arrangement, the wiring patterns 123 and 128 are shielded by the wiring pattern 121.

FIGS. 33 to 36 show an eighth embodiment of the present invention, which is concerned with the connection arrangement of the first contact elements 58*a* of the contact device 59 and the outer leads 55.

Figure 33:
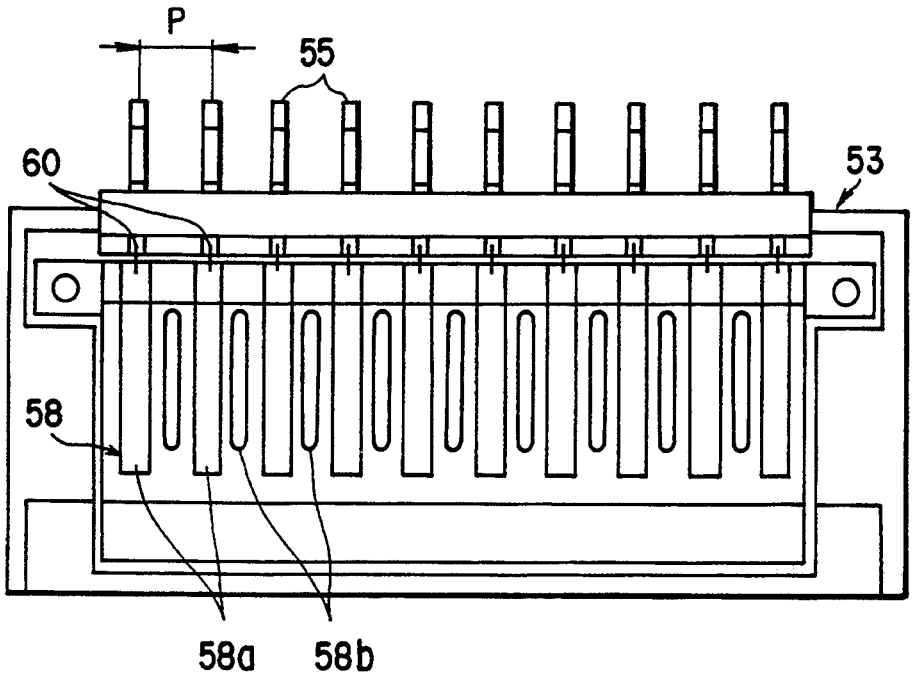
FIG. 33 which is associated with an eighth embodiment of the present invention, is a plan view of the state where first contact elements are connected to outer leads.

FIG. 33 schematically illustrates the construction shown in FIGS. 9 to 11.

The pitch of the first contact elements 58*a* of the TAB tape 58 and the pitch of the outer leads 55 of the board 53 are P. The first contact elements 58*a* are connected to the outer leads 55 by bonding wires 60.

Figure 34:
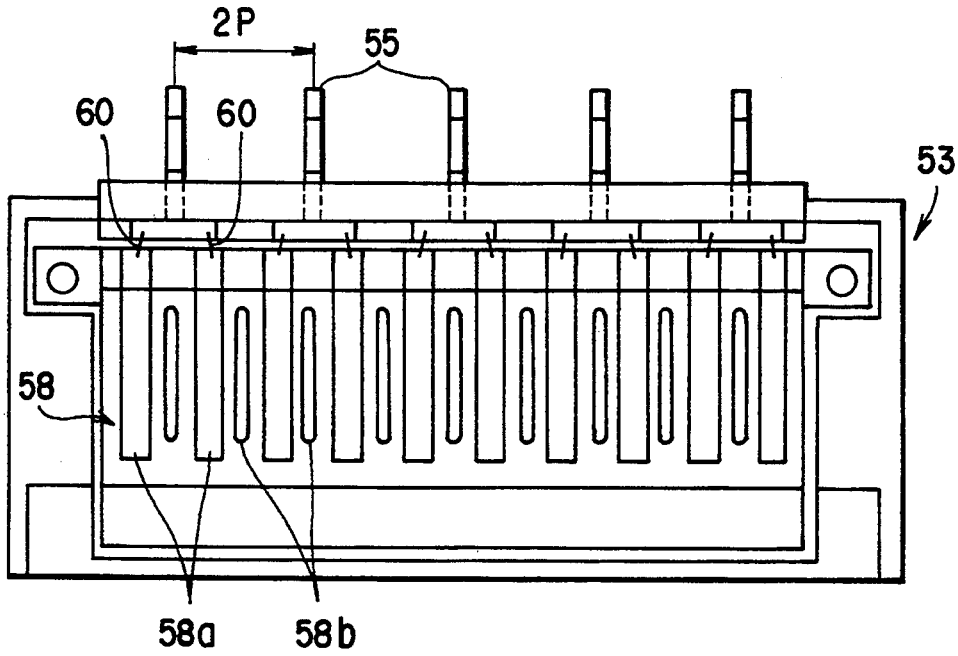
FIG. 34, which is associated with the eighth embodiment, is a plan view of the connected state different from that of FIG. 33.

FIG. 34 shows a case where the pitch of the first contact elements 58 is P, and the pitch of the outer leads 55 is 2P. In this case, sets of two first contact elements 58*a* are connected to the respective outer leads 55.

With the present embodiment, by changing the number of outer leads 55 connected to the first contact elements 58*a*, several types of connector devices can be constructed easily. Additionally, for a plurality of pitches of outer leads 55, the number of pitches of the first contact elements 58*a* of the TAB tape 58 may be one, which helps suppress the production cost.

With the configuration of FIG. 34, two first contact elements 58*a* are connected to one outer lead 55. This enables at least one of the pair of the first contact elements 58*a* to connect to the second contact element, improving the contact stability.

The number of first contact elements 58*a* connected to one outer lead 55 is not limited to two, but may be any integer more than two.

FIGS. 35A and 35B show a modification of FIG. 33. In the construction shown in FIGS. 33 and 34, the outer leads 55, which are provided on one side of the board 53 only, are connected to only one end of the first contact elements 58*a*.

In the case of FIGS. 35A and 35B, the outer leads 55 are provided on both sides of the board 53. The pitch of the outer leads 55 is set at 2P. The first contact elements 58*a* connected to the outer leads 55 are arranged alternately, starting from one edge of the TAB tape 58. This arrangement provides a dual-in-line connector device.

FIG. 36 shows the relationship between the pitch of first contact elements 58a of the TAB tape 58 and the size of the TAB tape 58. If the length 1 (pitch× the number of pins) of the TAB tape 58 in the direction in which the first contact elements 58*a* are arranged is constant, the first contact elements 58*a* at the outermost positions on both sides of the TAB tape 58 are located P/2 apart from both edges of the TAB tape 58. The pitch of the first contact elements 58*a* between the two outermost first contact elements 58*a* is set at P.

With this arrangement, as the pitch P of the first contact elements 58*a* is decremented by ½, 0.8 mm, 0.4 mm, and 0.2 mm, the number of the first contact elements 58*a* doubles and quadruples, 10, 20, and 40. Therefore, with the size of the board 53 in which TAB tape 58 is housed being constant, connector devices different in the number of the first contact elements 58a can be constructed, which allows the same parts including boards 53 to be used for various types of TAB tapes.

Figure 37:
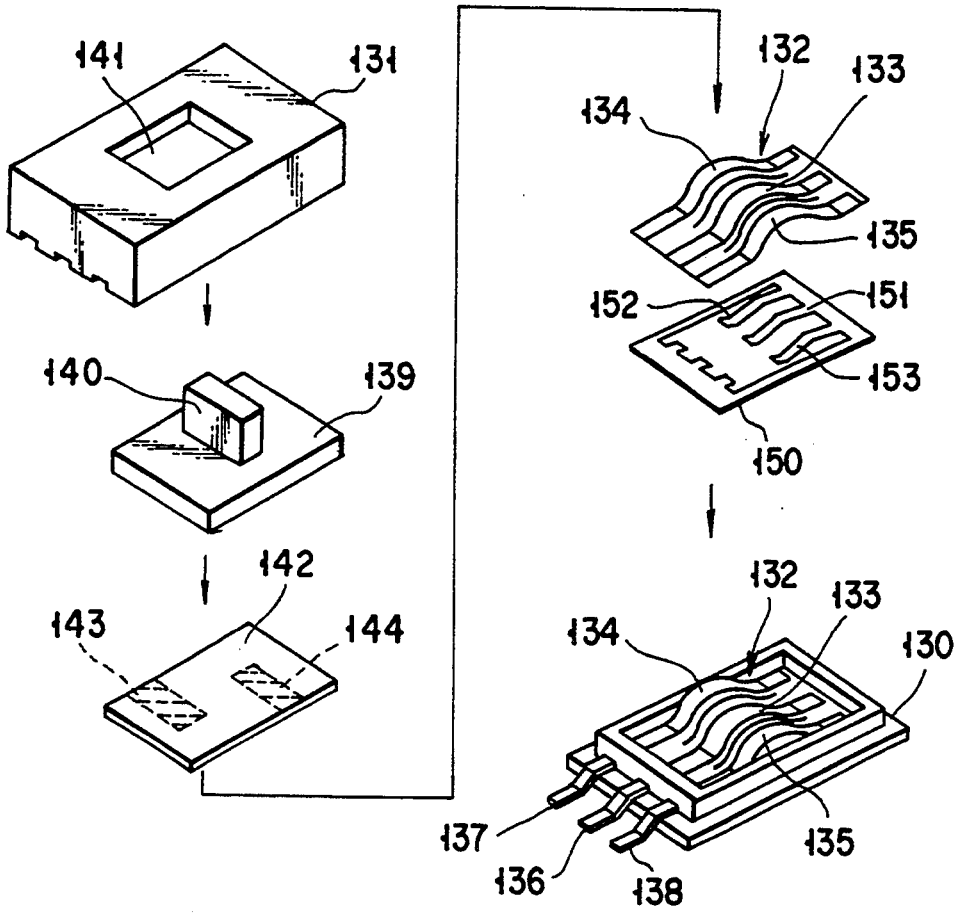
FIG. 37 which is concerned with a ninth embodiment of the present invention, is an exploded view of a switch device using a contact device of the present invention.
Figure 38:
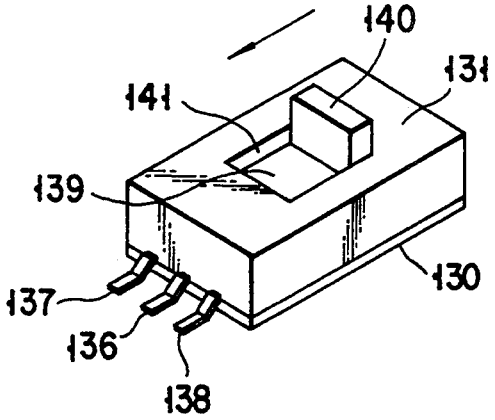
FIG. 38 is a perspective view of the assembled state of the device of FIG. 37.

FIGS. 37 and 38 show a ninth embodiment of the present invention, which is a switch device using the contact device 39.

In FIG. 37, a cover 131 is attached to the case 130. TAB tape 132 is housed in the case 130. The construction of the TAB tape 132 is the same as that with the contact device 39. Specifically, in the mid section of the surface of the TAB tape 132, a common contact element 133 is provided. On both sides of the common contact element 133, a first and second fixed contact elements 134 and 135 are provided. The common contact element 133, and the first and second fixed contact elements 134 and 135 are connected to the outer leads 136, 137, and 138 provided on the case 130. The mid section of the TAB tape 132 is curved together with the common contact element 133, and the first and second fixed contact elements 134 and 135. On the back of the TAB tape 132, a frame 150 is provided. The frame 150 is provided with a plurality of springs 151, 152, and 153. These springs 151, 152, and 153 are bonded to the back of the TAB tape 132 so as to correspond to the common contact element 133, and the first and second fixed contact elements 134 and 135. The free ends of these springs 151,152, and 153 are brought into contact with a projecting portion (not shown) formed on the case 130.

An actuating element 139 is provided in the cover 131 so as to slide freely. On the front of the actuating element 139, an operator element 140 to move the actuating element 139 is provided. The operator element 140 is stuck out of an opening 141 made in the cover 131. On the back of the actuating element 139, an insulating film 142 is provided. A first and second movable contact elements 143 and 144 are provided on the insulating film 142 along the movement of the actuating element 139.

With this arrangement, when the operator element 140 is in the position of FIG. 38, the first movable contact element 143 connects the first fixed contact element 134 to the common contact element 133. In this state, when the operator element 140 is moved in the direction of the arrow in the figure, the state where the first fixed contact element 134 is connected to the common contact element 133 by the first movable contact element 143 is canceled, and instead the second movable contact element 144 connects the second fixed contact element 135 to the common contact element 133.

With this arrangement, the pitch of the common contact element 133, and the first and second fixed contact elements 134 and 135 can be set in the range from 0.8 mm to 0.2 mm. This provides an ultra-compact slide switch.

This invention is not limited to the embodiments described herein. It may be practiced or embodied in still other ways without departing from the spirit or essential character thereof.

What is claimed is:

1. A connector device comprising:

a socket including: a socket body with an opening in one side;

a first contact member provided in said socket body, said first contact member comprising a TAB tape including a plurality of first contact elements patterned on the surface of the first contact member and slits defined between the first contact elements, the first contact member being curved so that said first contact elements have central raised portions;

a flat frame holding said first contact member in its curved state, one side of said first contact member being attached to one side of the frame and an opposite side of the first contact member being attached to another side of the frame; said first contact member extending from said one side of the frame to said opposite side of the frame and being free of support by said frame therebetween;

a plurality of springs each having one end attached to said one side of the frame and an opposite end which is left free, said springs being mounted at the back of said first contact member so as to correspond to and bias said first contact elements; said frame being mounted in said socket body in flat, undeformed state, and a plug including:

an insert portion that can be inserted in said opening; and a second contact member provided on said insert portion, said second contact member comprising a TAB tape including second contact elements provided in a pattern on the surface of the second contact member so that said second contact elements make contact with said first contact elements of the first contact member.

2. A device according to claim 4, wherein the insert portion of said plug is made thinner toward its tip, and the inside of said socket is sloped so as to be narrower from said opening inward in conjunction with the thickness of said insert portion.

3. A device according to claim 1, further comprising a projecting portion formed on said socket body to contact said opposite ends of the plurality of springs when said insert portion is inserted into said opening in the socket.

4. A device according to claim 1, further comprising:

a first guide member provided on the insert portion of said plug, the guide member being located in the direction in which said plug is inserted;

a first engaging portion formed in part of said first guide member;

a second guide member provided on said socket body, the second guide member directing said first guide member;

a moving member provided on said socket body, the moving member being able to move in the direction of said first contact elements transversely of the insertion direction of the insert portion; and a second engaging portion formed on said moving member, the second engaging portion engaging with said first engaging portion to lock the plug in said socket.

5. A device according to claim 1, further comprising a cable having spaced leads provided in said socket body and connected to at least one of said first contact elements, said leads being spaced at a pitch which is an integral multiple of P, wherein P represents the pitch of the first contact elements.

6. A device according to claim 1, wherein the distance between the outermost first contact elements and their associated adjacent edges of said first contact member is P/2.

7. A connector device comprising:

a socket including:

a socket body with an opening in one side;

first and second contact members each comprising a TAB tape provided in said socket body so as to face each other, with a plurality of first contact elements patterned on the surfaces of the first and second contact members, the first and second contact members being curved so that said first contact elements have central raised portions, said first and second contact members including slits defined between the first contact elements;

a flat frame holding said first contact member in its curved state, one side of said first contact member being attached to one side of the frame and an opposite side of the first contact member being attached to another side of the frame; said first contact member extending from said one side of the frame to said opposite side of the frame and being free of support by said frame therebetween;

a plurality of springs each having one end attached to said one side of the frame and an opposite end which is left free, said springs being mounted at the back of said first contact member so as to correspond to and bias said first contact elements; said frame being mounted in said socket body in flat, undeformed state, a plug including:

an insert portion that can be inserted in said opening; and third and fourth contact members each comprising a TAB tape provided on both sides of said insert portion, with second contact elements patterned on the surfaces of the third and fourth contact members, so that said second contact elements can make contact with said first contact elements of the first and second contact members.

8. A contact device comprising:

a sheet-like contact member including a plurality of contact elements patterned on its surface and slits defined between the contact elements, a frame holding said contact member in a curved state, one side of the contact member being attached to one side of the frame and an opposite side of the contact member being attached to another side of the frame, said contact member extending from said one side of the frame to said opposite side of the frame and being free of support by said frame therebetween; and a plurality of springs provided on said frame, said frame being supported in flat, undeformed state, said springs being arranged in correspondence with said contact elements and being pressed against the back of said contact member, each of the contact elements being movable separately.

9. A device according to claim 8, wherein one end of each of said plurality of springs is attached to said frame, and the other end is left free.

10. A contact device comprising:

a socket body with an opening in one side thereof;

a sheet-like contact member provided in said socket body, and including a plurality of contact elements patterned on the surface of the contact member, the contact member being curved so that said contact elements have raised intermediate portions, said surface including slits defined between the contact elements;

a flat frame holding said contact member in a curved state, one side of the contact member being attached to one side of the frame and an opposite side of the contact member being attached to another side of the frame, said contact member extending from the sides of the frame across the frame without support by said frame between said sides, said frame being supported in flat undeformed state; and a plurality of springs each having one end attached to said one side of said frame and an opposite end which is left free, said springs being mounted on the back of said first contact member in correspondence with said first contact elements to bias said first contact elements.

11. A contact device comprising:

a socket body with an opening in one side thereof;

a sheet-like contact member provided in said socket body, and including a plurality of contact elements patterned on the surface of the contact member, the contact member being curved so that said contact elements have raised intermediate portions, said surface including slits defined between the contact elements, to provide a pitch for the contact elements at 0.5 mm or less;

a flat frame holding said contact member in a curved state, one side of the contact member being attached to one side of the frame and an opposite side of the contact member being attached to another side of the frame, said contact member extending from the sides of the frame across the frame without support by said frame between said sides, said frame being supported in flat undeformed state; and a plurality of springs each having one end attached to said one side of said frame and an opposite end which is left free, said springs being mounted on the back of said first contact member in correspondence with said first contact elements to bias said first contact elements.

12. A contact device comprising:

a socket including;

a socket body with an opening in one side thereof;

a sheet-like first contact member provided in said socket, and including a plurality of first contact elements patterned on the surface of the first contact member, said first contact member being bent so that said first contact elements have raised intermediate portions;

a flat frame holding said first contact member;

a plurality of springs each having one end attached to said frame and an opposite end which is left free, said springs being mounted at the back of said first contact member in correspondence with said first contact elements to bias said first contact elements; and a plug including:

an insert portion that can be inserted in said opening in the socket;

a sheet-like second contact member provided on said insert portion and including second contact elements patterned on the surface of the second contact member for making contact with said first contact elements;

a plug body integrally formed with said insert portion;

a pressure contact plate in said plug body in contact with the back of said second contact member;

a plurality of projecting pressure contact portions formed on said pressure contact plate, said pressure contact portions corresponding to said second contact elements;

a cable in which a plurality of leads are arranged in parallel, the cable being in contact with each of said second contact elements;

a cover attached to said plug body; and a projecting portion formed on said cover, which clamps said second contact elements and the leads of the cable together with the pressure contact portions of said pressure contact plate.

* * * * *